US011976644B2

(12) United States Patent
Lim et al.

(10) Patent No.: US 11,976,644 B2
(45) Date of Patent: May 7, 2024

(54) COMPRESSOR

(71) Applicant: LG Electronics Inc., Seoul (KR)

(72) Inventors: Hyeongjun Lim, Seoul (KR); Kwangwook Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/710,073

(22) Filed: Mar. 31, 2022

(65) Prior Publication Data

US 2022/0389918 A1 Dec. 8, 2022

(30) Foreign Application Priority Data

Jun. 4, 2021 (KR) ..... 10-2021-0072998

(51) Int. Cl.
*F04B 35/04* (2006.01)
*F04B 39/00* (2006.01)
(Continued)

(52) U.S. Cl.
CPC ..... *F04B 35/045* (2013.01); *F04B 39/121* (2013.01); *F04B 39/125* (2013.01);
(Continued)

(58) Field of Classification Search
CPC .. F04B 35/045; F04B 39/0027; F04B 39/121; F04B 39/122; F04B 39/125;
(Continued)

(56) References Cited

U.S. PATENT DOCUMENTS

2003/0133816 A1* 7/2003 Park ..... F04B 39/0061 417/551
2012/0063937 A1* 3/2012 Moreira ..... F04B 39/122 417/437
2019/0309746 A1* 10/2019 Kim ..... F04B 39/121

FOREIGN PATENT DOCUMENTS

DE 60129256 10/2007
DE 112007000156 1/2015
(Continued)

OTHER PUBLICATIONS

Notice of Allowance in Korean Appln. No. 10-2021-0072998, dated Apr. 10, 2023, 9 pages (with English translation).
(Continued)

*Primary Examiner* — Kenneth J Hansen
*Assistant Examiner* — David N Brandt
(74) *Attorney, Agent, or Firm* — Fish & Richardson P.C.

(57) ABSTRACT

The present disclosure relates to a compressor including a case, a compression unit provided inside the case, and a driving unit, wherein the compression unit includes a cylinder having a compression space, a piston reciprocating inside the cylinder, a discharge cover covering the compression space, a first plenum disposed inside the discharge cover and having a discharge space and a coupling space, a second plenum disposed inside the discharge cover and defining a movement channel through which refrigerant moves, a rib disposed in the movement channel, and a communicating portion through which the discharge space and the movement channel communicate with each other,
(Continued)

wherein the refrigerant discharged from the compression space moves along the discharge space, the communicating portion, and the movement channel, whereby pulsation caused by the discharge of the refrigerant can be reduced.

16 Claims, 20 Drawing Sheets

(51) Int. Cl.
*F04B 39/02* (2006.01)
*F04B 39/12* (2006.01)

(52) U.S. Cl.
CPC ..... *F04B 39/0005* (2013.01); *F04B 39/0055* (2013.01); *F04B 39/0061* (2013.01); *F04B 39/0072* (2013.01); *F04B 39/0292* (2013.01)

(58) Field of Classification Search
CPC ..... F04B 39/0005; F04B 39/0055; F04B 39/0061; F04B 39/0072; F04B 39/0292
See application file for complete search history.

(56) References Cited

FOREIGN PATENT DOCUMENTS

| | | |
|---|---|---|
| DE | 102021200101 | 7/2021 |
| KR | 100314036 | 11/2001 |
| KR | 10-2019-0040814 | 4/2019 |
| KR | 10-2019-0118425 | 10/2019 |
| KR | 10-2019-0118426 | 10/2019 |
| KR | 10-2060175 | 12/2019 |
| KR | 10-2020-0056777 | 5/2020 |

OTHER PUBLICATIONS

Office Action in German Appln. No. 102022104367.3, dated Nov. 4, 2022, 9 pages (with English translation).

* cited by examiner

COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2021-0072998, filed on Jun. 4, 2021, the contents of which are incorporated by reference herein in their entirety.

TECHNICAL FIELD

The present disclosure relates to a compressor.

BACKGROUND

As is well known, a compressor is an apparatus that receives power from a power generating device such as a motor or a turbine and compresses a working fluid such as air or refrigerant (refrigerant gas). In detail, compressors are widely applied to industrial fields and household appliances, particularly, steam compression refrigeration cycles (hereinafter, referred to as 'refrigeration cycles'), and the like.

These compressors may be classified into a reciprocating compressor, a rotary compressor, and a scroll compressor according to a method of compressing refrigerant. Such a compressor generally includes a shell or case (hereinafter, referred to as a 'case') defining a hermetic space, a compression unit disposed inside the case, and a driving unit (or motor unit) applying driving force to the compression unit.

The compression unit includes a compression space, a suction port and a discharge port communicating with the compression space, a suction valve for opening and closing the suction port, and a discharge valve for opening and closing the discharge port.

The compressor sucks gas or refrigerant (hereinafter, referred to as "gas") into the case through a suction pipe, and the gas sucked into the case is introduced into the compression space through the suction port and compressed in the compression space. The gas compressed in the compression space is moved to a discharge pipe through the discharge port and then discharged out of the case through the discharge pipe.

However, in the related art compressor, vibration and noise are generated from moving parts during the suction, compression, and discharge of the gas.

In particular, noise is greatly increased when the compressed gas is discharged. Thus, the compressor includes a discharge muffler disposed in a discharge-side flow path of the compression unit to attenuate the noise generated during the discharge of the gas.

The discharge muffler includes a plurality of partition walls defining a plurality of discharge spaces therein, and a plurality of outlet holes formed through the plurality of partition walls such that the discharge spaces can communicate with each other. The discharge muffler is configured to reduce pulsation while discharged refrigerant in a compressed state alternately passes through the discharge spaces (resonance chambers) and the outlet holes inside the discharge muffler. Here, the discharge spaces and the outlet holes are set in consideration of frequency response characteristics.

However, in the related art compressor, since the outlet hole is formed through the partition wall having a relatively thin thickness, a sufficient acoustic equivalent mass is not secured, which is disadvantageous to reduce the pulsation due to the discharge of the refrigerant.

In particular, the acoustic equivalent mass is inversely proportional to a cross-sectional area of the outlet hole and proportional to a length of the outlet hole. When the cross-sectional area of the outlet hole is reduced to increase the acoustic equivalent mass, flow resistance is rapidly increased, which lowers efficiency of the compressor.

In addition, when a separate pipe is directly attached for the discharge spaces to communicate with each other, a manufacturing process becomes complicated.

An installation space of the pipe for the communication between the discharge spaces is difficult to be secured inside a discharge cover having a narrow inner space.

It is also difficult to connect the pipe for the communication between the discharge spaces and the partition wall and to secure reliability of a connected portion between the pipe and the partition wall.

If the pipe for the connection between the discharge spaces is installed via an outside of the discharge cover to avoid the narrow inner space of the discharge cover, a region of the pipe (refrigerant of high temperature and high pressure) passing through the outside of the discharge cover and refrigerant inside the case exchange heat. As a result, temperature and pressure of the refrigerant (high temperature and high pressure) inside the pipe are lowered while temperature of the refrigerant (before compressed) outside the discharge cover is increased, thereby deteriorating refrigerant compression efficiency.

PRIOR ART DOCUMENTS

Patent Documents (Patent Document 1) KR100314036 B1

SUMMARY

Therefore, the present disclosure describes a compressor capable of reducing pulsation due to discharge of refrigerant.

The present disclosure also describes a compressor capable of suppressing a generation of noise without increasing flow resistance during discharge of refrigerant. The present disclosure further describes a compressor capable of suppressing temperature of discharged refrigerant from being lowered and increasing an acoustic equivalent mass of a discharge muffler.

The present disclosure further describes a compressor capable of eliminating a use of a pipe connecting discharge spaces inside a discharge muffler and preventing operation efficiency from being lowered due to the pipe.

In order to achieve these and other advantages and in accordance with the purpose of this specification, a compressor may be configured such that refrigerant moves via a coupling space between a first plenum and a second plenum.

More specifically, the compressor may include a discharge cover, and a first plenum and a second plenum coupled to an inside of the discharge cover in an axial direction. Refrigerant can move in a coupling space, which is defined in a circumferential direction such that one end portion of the second plenum can be inserted into the first plenum in the axial direction. This can increase an acoustic equivalent mass of the discharge cover in which the refrigerant moves.

Accordingly, pulsation generated due to refrigerant discharged from a compression space can be reduced.

In addition, the refrigerant can pass through the coupling space defined inside the first plenum disposed in the discharge cover. Therefore, thermal energy of the refrigerant moving in the discharge cover can be suppressed from being transferred to refrigerant outside the discharge cover.

This can prevent compression efficiency of refrigerant from being lowered due to an increase in temperature of the refrigerant outside the discharge cover.

The compressor may include a case, a compression unit provided in the case to compress refrigerant, and a driving unit disposed in the case to apply driving force to the compression unit.

The compression unit may include a cylinder defining a compression space therein, and a piston reciprocating inside the cylinder and varying the compression space. A discharge cover for covering the compression space may be disposed at one side of the cylinder.

A first plenum and a second plenum that are coupled to each other to define a plurality of discharge spaces may be disposed in the discharge cover in the axial direction.

A compressor according to one implementation of the present disclosure may include a case, a compression unit disposed in the case to compress refrigerant, and a driving unit disposed in the case to apply driving force to the compression unit. The compression unit may include a cylinder defining a compression space therein, a piston reciprocating inside the cylinder and varying the compression space, a discharge cover covering the compression space, a first plenum disposed inside the discharge cover and having a discharge space to communicate with the compression space, and a coupling space partitioned from the discharge space, formed at an outer side of the discharge space in a circumferential direction, and having one side open in an axial direction, a second plenum disposed inside the discharge cover, and having an end portion blocking an opening of the coupling space in the axial direction when the second plenum is coupled, so as to define a movement channel for movement of the refrigerant, a rib disposed inside the movement channel to block the movement channel, and a communicating portion through which the discharge space and the movement channel communicate with each other.

Here, the movement channel may have a narrow width and a long length.

The rib may have a cross-sectional area that is substantially the same as a flow cross-sectional area of the movement channel so as to block the movement channel, which can allow refrigerant introduced into the movement channel to move in only one direction without passing through the rib.

With this configuration, refrigerant discharged from the compression space can move along the movement channel, which can increase an acoustic equivalent mass, thereby reducing pulsation.

Accordingly, a noise generation due to the pulsation can be suppressed during an operation of the compressor.

The case may have a cylindrical shape.

The case may have a length longer than a diameter.

The case may be installed so that the length of the case is arranged in a horizontal direction.

The cylinder may have a cylindrical shape with both ends open.

The piston may have a cylindrical shape with one end portion closed.

The piston may have a head formed on its one end portion.

Suction ports through which refrigerant is sucked may be formed through the head.

A suction valve may be provided at the head to open and close the suction ports.

A discharge valve may be disposed at one side of the cylinder to selectively open and close the compression space.

The piston may reciprocate between a top dead center and a bottom dead center inside the cylinder.

A frame may be provided at an outer side of the cylinder.

The frame may include a body portion surrounding an outer surface of the cylinder, and a flange portion extending from one end portion of the body portion in a radial direction.

The driving unit may include a stator and a mover reciprocating relative to the stator.

The stator may include an outer stator and an inner stator arranged concentrically with each other, and a stator coil wound around the outer stator and/or the inner stator.

The mover may include permanent magnets.

The permanent magnets may be disposed between the outer stator and the inner stator to reciprocate along the axial direction.

In one implementation, the communicating portion may include an inlet and an outlet spaced apart from each other with interposing the rib therebetween in the circumferential direction.

The inlet and outlet may be disposed adjacent to the rib.

With this configuration, refrigerant introduced into the movement channel through the inlet provided at one side of the rib can move along almost an entire circumference of the first plenum in the circumferential direction of the first plenum. Therefore, a movement length inside the movement channel can be remarkably increased.

This can remarkably increase an equivalent mass of the movement channel and thus can significantly reduce pulsation and noise due to the pulsation.

In one implementation, the inlet, the outlet, and the movement channel may have the same cross-sectional area.

By virtue of the uniform cross-sectional area, flow resistance of refrigerant can be constantly maintained without being increased during the movement of the refrigerant.

In one implementation, the first plenum may include an outer wall and an inner wall that are concentrically disposed with the coupling space defined therebetween.

Accordingly, since the movement channel along which the refrigerant moves is defined at an inner side of the outer wall, thermal energy of the refrigerant in the discharge cover can be prevented from being transferred to outside of the discharge cover by virtue of the outer wall (thickness of the outer wall) of the first plenum and a thickness (thickness of a wall surface) of the discharge cover.

The second plenum may include a cylindrical portion having one end portion inserted into the coupling space.

The inlet and the outlet may be formed by cutting the cylindrical portion.

In one implementation, the inner wall of the first plenum may include a first inner wall disposed at an inner side of the outer wall, a second inner wall protruding from the first inner wall in the axial direction, and outflow guides protruding from the second inner wall in the radial direction and spaced apart from each other in the circumferential direction.

The discharge space may include a first discharge space defined at an inner side of the first inner wall, a second discharge space defined at an inner side of the second inner wall, a third discharge space defined at an inner side of the outflow guides, and a fourth discharge space defined at an outer side of the outflow guides.

The third discharge space and the movement channel may communicate with each other through the inlet.

Accordingly, refrigerant in the third discharge space can be introduced into the movement channel through the inlet.

The fourth discharge space and the movement channel may communicate with each other through the outlet.

Accordingly, the refrigerant moved along the movement channel can move to the fourth discharge space through the outlet.

In one implementation, the second inner wall may include an arcuate section formed in an arcuate shape, and a linear section linearly connecting both end portions of the arcuate section.

The second plenum may include a protruding portion protruding inward in the axial direction and the radial direction to be in contact with the linear section.

The fourth discharge space may be defined at an inner side of the protruding portion.

Accordingly, an inner surface of a part, disposed in the axial direction, of a side portion of the protruding portion may come in contact with an outer surface of the linear section, so that the first plenum and the second plenum can be accurately coupled to each other at a preset position.

In one implementation, the first inner wall may include first outlet holes through which refrigerant in the first discharge space moves to the second discharge space, and the second inner wall may include a second outlet hole through which refrigerant in the second discharge space moves to the third discharge space.

Accordingly, refrigerant discharged from the compression space can move to the third discharge space while sequentially passing through the first discharge space, the first outlet holes, the second discharge space, and the second outlet hole.

The rib may include a first rib and a second rib spaced apart from each other in the circumferential direction to partition the movement channel into a first movement channel and a second movement channel in the circumferential direction.

Accordingly, the movement channel may be divided into the first movement channel and the second movement channel having relatively short lengths.

The first rib may be disposed between (at an inner side of) two extension lines respectively extending from the outflow guides in the axial direction.

Accordingly, one end portion of each of the first movement channel and the second movement channel may be located between the outflow guides.

In one implementation, the first rib and the second rib may be disposed to face each other such that the first movement channel and the second movement channel can have the same length.

Here, since the first and second movement channels have the same cross-sectional area, the first and second movement channels can have substantially the same equivalent mass.

In one implementation, the inlet may include a first inlet communicating with the first movement channel and a second inlet communicating with the second movement channel.

The first inlet and the second inlet may be disposed between extension lines extending axially from the outflow guides.

Accordingly, refrigerant in the third discharge space can move to the first and second movement channels through the first inlet and the second inlet, respectively.

The outlet may include a first outlet communicating with the first movement channel and a second outlet communicating with the second movement channel.

In one implementation, a cross-sectional area of the second outlet hole may be the same as a sum of a cross-sectional area of the first movement channel and a cross-sectional area of the second movement channel.

Accordingly, an increase in flow resistance can be suppressed when refrigerant passed through the second outlet hole moves divergently into the first movement channel and the second movement channel.

Here, the first inlet and the second inlet may have the same cross-sectional area.

The first outlet and the second outlet may have the same cross-sectional area. In one implementation, the first plenum may further include a division guide dividing the third discharge space into a first partial discharge space and a second partial discharge space.

The third discharge space may be divided into the first partial discharge space and the second partial discharge space by the division guide.

Here, the division guide may be disposed at a position where the first partial discharge space and the second partial discharge space have the same volume.

The second outlet hole may include a first partial outlet hole communicating with the first partial discharge space and a second partial outlet hole communicating with the second partial discharge space.

The first inlet may communicate with the first partial discharge space and the second inlet may communicate with the second partial discharge space.

Accordingly, refrigerant in the second discharge space can flow into the first partial discharge space and the second partial discharge space through the first partial discharge hole and the second partial discharge hole, respectively, and move to the first movement channel and the second movement channel through the first inlet and the second inlet.

In one implementation, a cross-sectional area of the first partial outlet hole may be the same as a cross-sectional area of the first movement channel.

A cross-sectional area of the second partial outlet hole may be the same as a cross-sectional area of the second movement channel.

Accordingly, an increase in flow resistance due to a change in flow cross-sectional area during the movement of the refrigerant can be suppressed.

In one implementation, the discharge cover may include a discharge groove that can communicate with outside.

The second plenum may include an outlet portion having an outlet groove through which refrigerant in the fourth discharge space is discharged out to the discharge groove.

In one implementation, the case may include a discharge pipe through which refrigerant is discharged, and the discharge groove may include a discharge hole communicating with the discharge pipe.

The discharge hole may be connected with one end of a loop pipe which has another end communicating with the discharge pipe.

In one implementation, the cylinder may include a nozzle to spray the refrigerant into a gap defined between an inner circumferential surface of the cylinder and an outer circumferential surface of the piston.

The nozzle may penetrate through a wall surface of the cylinder in the radial direction.

With the configuration, friction between the cylinder and the piston can be reduced.

The discharge groove may include a gas bearing hole communicating with the nozzle.

The refrigerant (gas) in the discharge groove can move through the gas bearing hole and then flow along the refrigerant (gas) movement path defined in the frame (the flange portion and the body portion), so as to be introduced into the cylinder through the nozzle.

In one implementation, the outlet portion may protrude from the cylindrical portion in the radial direction and extend in the axial direction, and the outlet groove may be formed through an inside of the outlet portion in the axial direction.

Here, an inner end portion of the outlet groove may communicate with an inner surface of the cylindrical portion in the radial direction.

Accordingly, refrigerant discharged from the compression space after being compressed can move to the discharge groove sequentially via the first discharge space, the first outlet holes, the second discharge space, the second outlet hole, the third discharge space, the inlet, the movement channel, the outlet, and the fourth discharge space.

As described above, according to an implementation of the present disclosure, a movement channel that is relatively narrow and long can be defined in a coupling space defined between a first plenum and a second plenum, which are coupled to each other in an axial direction within a discharge cover, thereby increasing an equivalent mass and thus reducing noise.

In addition, since the movement channel is defined inside the first plenum disposed in the discharge cover, thermal energy of refrigerant can be effectively prevented from being transferred to outside of the discharge cover while the refrigerant moves along the movement channel.

Since a communicating portion includes an inlet and an outlet spaced apart from each other with a rib interposed therebetween, an entire inner region of the movement channel can be used as a space where refrigerant actually moves.

Since the inlet, the outlet, and the movement channel have the same cross-sectional area, an increase in flow resistance due to a change in a flow cross-sectional area of refrigerant can be suppressed.

With a configuration that a first discharge space is defined at an inner side of a first inner wall of the first plenum, a second discharge space is defined at an inner side of a second inner wall, a pair of outflow guides radially extending are disposed at an outer side of the second inner wall, a third discharge space is defined at an inner side of the outflow guides, a fourth discharge space is defined at an outer side of the outflow guides, and refrigerant in the third discharge space moves to the fourth discharge space via the movement channel, an acoustic equivalent mass of a refrigerant movement path can be remarkably increased. This can significantly reduce vibration and noise.

First and second ribs may be disposed in the movement channel to be spaced apart from each other in a circumferential direction, to divide the movement channel into a first movement channel and a second movement channel. Accordingly, an increase in flow resistance of refrigerant can be suppressed and the equivalent mass can be increased, thereby reducing vibration and noise.

The first rib may be provided between extension lines extending from the outlet guides in the axial direction, such that one end portion of the first movement channel and one end portion of the second movement channel can be located at an inner side of the outflow guides. Accordingly, refrigerant in the third discharge space can move divergently into the first movement channel and the second movement channel.

A cross-sectional area of the second outlet hole is the same as a sum of a flow cross-sectional area of the first movement channel and a flow cross-sectional area of the second movement channel, an increase in flow resistance due to a change in flow cross-sectional area when the refrigerant moves can be suppressed.

The first plenum can include a division guide for dividing the third discharge space defined at an inner side of the outflow guides into a first partial discharge space and a second partial discharge space, a first partial discharge hole through which the second discharge space communicates with the second partial discharge space, and a second partial discharge hole through which the second discharge space communicates with the second partial discharge space. With the configuration, refrigerant in the second discharge space can move divergently into the first partial discharge space and the second partial discharge space.

DETAILED DESCRIPTION

Hereinafter, implementations disclosed in this specification will be described in detail with reference to the accompanying drawings. In this specification, the same or equivalent components may be provided with the same or similar reference numbers even in different implementations, and description thereof will not be repeated. A singular representation used herein may include a plural representation unless it represents a definitely different meaning from the context. In describing the present invention, if a detailed explanation for a related known technology or construction is considered to unnecessarily divert the gist of the present disclosure, such explanation has been omitted but would be understood by those skilled in the art. It should be noted that the attached drawings are provided to facilitate understanding of the implementations disclosed in this specification, and should not be construed as limiting the technical idea disclosed in this specification by the attached drawings.

Figure 1:
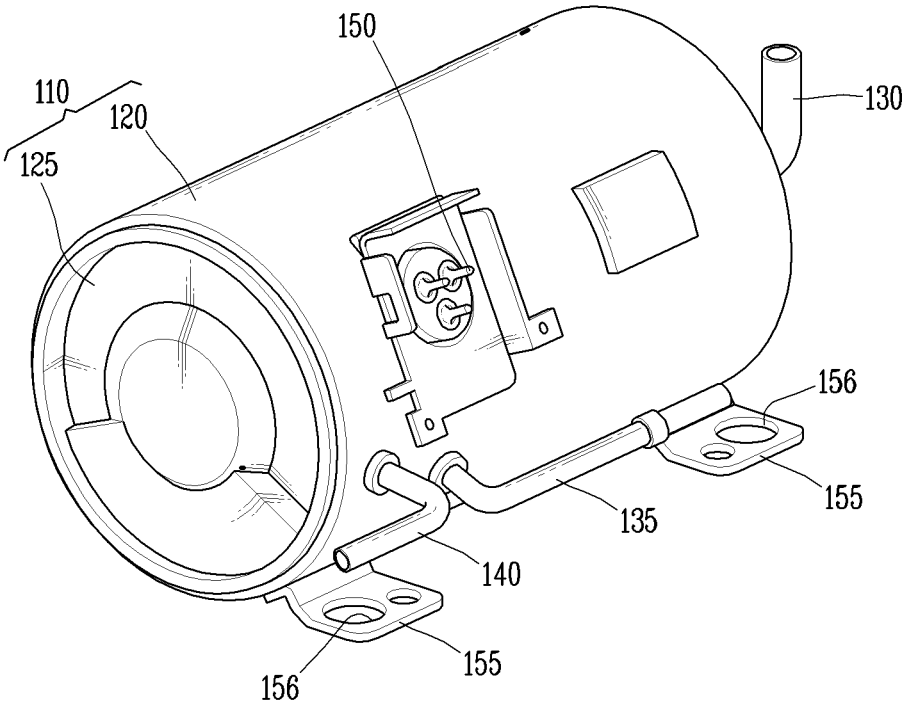
FIG. 1 is a perspective view illustrating a compressor in accordance with one implementation of the present disclosure.
Figure 2:
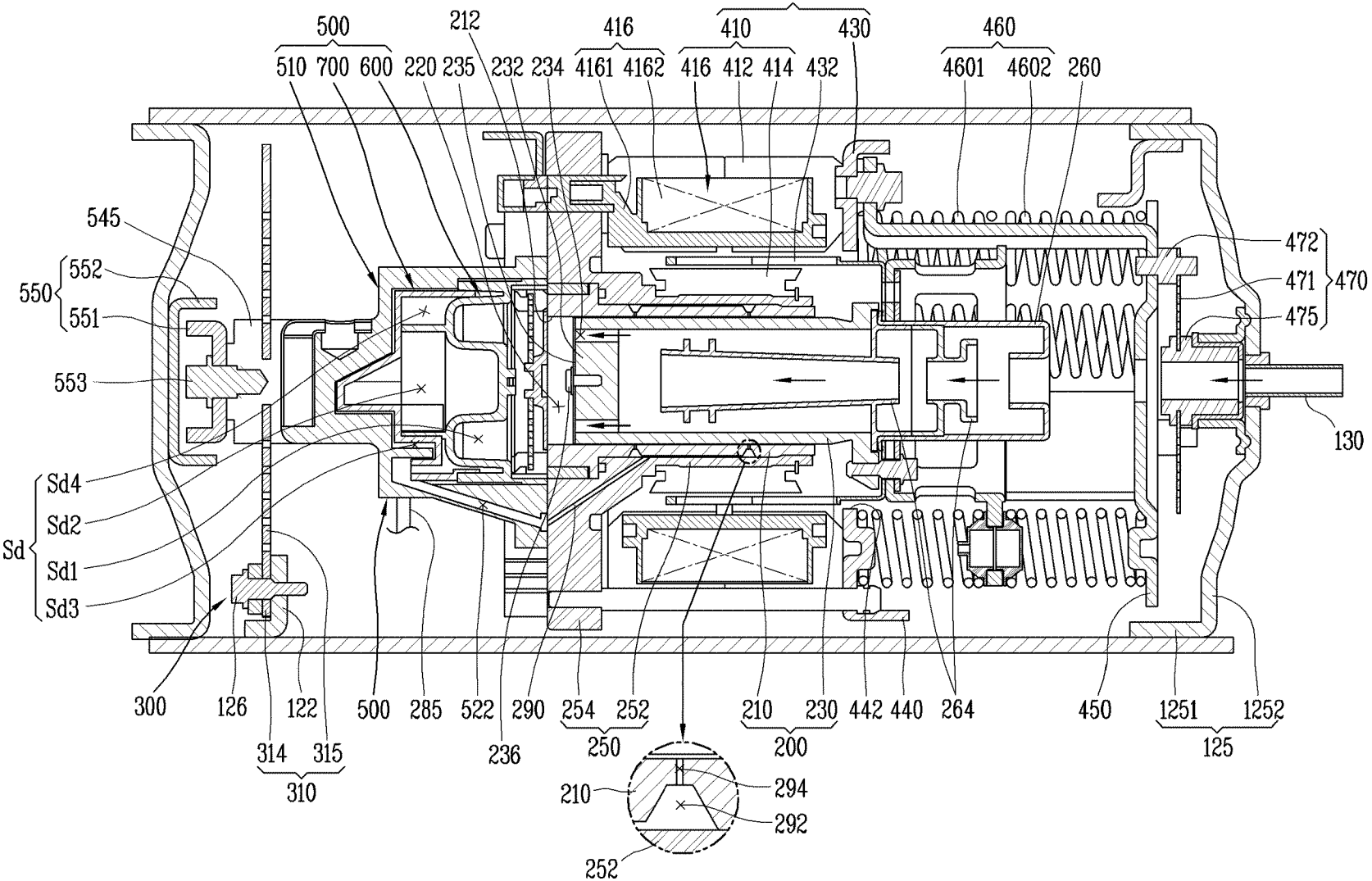
FIG. 2 is a sectional view illustrating the compressor of FIG. 1.

FIG. 1 is a perspective view illustrating a compressor in accordance with one implementation of the present disclosure, and FIG. 2 is a sectional view illustrating the compressor of FIG. 1. As illustrated in FIGS. 1 and 2, a compressor according to this implementation may include a case 110, a compression unit 200, and a driving unit 400.

The case 110 may have a substantially cylindrical shape.

The case 110 may include a case body 120 having both sides open and covers 125 coupled to close the openings of the case body 120.

The cover 125 may include, for example, a disk portion 1251 having a disk shape and a skirt portion 1252 protruding from an edge of the disk portion 1251 in an axial direction and extending in a circumferential direction. The skirt portion 1252, for example, may have an outer surface in close contact with an inner surface of the case body 120. The covers 125 may be coupled to hermetically seal end portions of the case body 120, respectively. Accordingly, a hermetic space may be defined in the case 110.

The compressor according to this implementation may be disposed so that the case 110 is disposed horizontally in its lengthwise direction. This can remarkably reduce a height of an installation space for the compressor.

When the compressor is installed in a machine room of a refrigerator, for example, the machine room can be significantly lowered in height. Since the height of the machine room is reduced without increasing an outer height of the refrigerator (cabinet), a food storage space (freezing chamber, refrigerating chamber, storage chamber) defined in the cabinet can be remarkably increased in size.

In this implementation, the horizontal direction may mean a right and left direction in FIG. 1.

The right and left direction in FIG. 1 may also be expressed as a front and rear direction.

For example, a left end portion of the case 110 of the compressor may be referred to as a front end portion of the case 110, and a right end portion of the case 110 may be referred to as a rear end portion of the case 110.

A suction pipe 130 through which gas (refrigerant) to be compressed is sucked may be provided at the case 110.

The suction pipe 130 may be disposed at a rear end portion of the case 110.

The case 110 may be provided with a discharge pipe 135 through which compressed gas (refrigerant) is discharged.

The discharge pipe 135 may be connected to one side surface of the case 110.

A process pipe 140 for filling refrigerant into the case 110 may be provided at one side of the discharge pipe 135.

The case 110 may be provided with a terminal 150 connected to an external power supply.

The terminal 150 may be provided on one side surface of the case 110.

The case 110 may be provided with a plurality of legs 155 by which the compressor is fastened to an object.

The plurality of legs 155 may be provided as a pair on each of both sides of a lower portion of the case 110.

The plurality of legs 155 may be provided as a pair on each of a front lower portion and a rear lower portion of the case 110. Through-holes 156 may be formed through planes of end portions of the plurality of legs 155, respectively.

The compression unit 200 may be disposed inside the case 110.

The compression unit 200 may include, for example, a cylinder 210 and a piston 230 reciprocating within the cylinder 210.

The cylinder 210 may be formed, for example, in a cylindrical shape with both sides open.

The cylinder 210 may be disposed in the case 110 in a longitudinal (lengthwise) direction, and the piston 230 may be disposed in the cylinder 210 to reciprocate along the longitudinal direction of the case 110.

A frame 250 may be disposed outside the cylinder 210.

The frame 250 may include, for example, a body portion 252 surrounding the cylinder 210, and a flange portion 254 extending in a radial direction from one end portion (front end portion) of the body portion 252.

The cylinder 210 may be supported by the frame 250.

The cylinder 210 may be press-fitted to an inner surface of the body portion 252.

In this implementation, a reciprocating direction of the piston 230 may mean the same direction as an axial direction.

The driving unit 400 may be disposed at one region (rear region) of the flange portion 254 in the axial direction.

The driving unit 400 may include, for example, a stator 410 and a mover 430 reciprocating with respect to the stator 410.

The stator 410 may include, for example, an outer stator 412 and an inner stator 414 that are concentrically disposed with each other, and a stator coil 416 wound around the inner stator 414 and/or the outer stator 412. This implementation illustrates the case where the stator coil 416 is disposed at an inner side of the outer stator 412, but this is merely illustrative and the present disclosure may not be limited to this. The stator coil 416 may receive power by being electrically connected to the terminal 150.

The stator coil 416 may include a bobbin 4161 and a coil portion 4162 wound around the bobbin 4161. When power is applied, the coil portion 4162 may generate a magnetic flux and interact with a magnetic flux of permanent magnets 432 to be explained later, such that the permanent magnets 432 (the mover 430) reciprocates in the axial direction.

The outer stator 412 and the inner stator 414 may be formed by, for example, stacking magnetic steel sheets in an insulating manner along a circumferential direction. In this implementation, the outer stator 412 and the inner stator 414 may also be referred to as an outer stator core and an inner stator core.

The bobbin 4161 and the inner stator 414 may be spaced apart from each other in a radial direction.

The mover 430 may be disposed between the bobbin 4161 and the inner stator 414 to reciprocate along the axial direction.

A stator cover 440 may be coupled to a rear end portion of the stator 410.

A through-portion 442 may be formed through a center of the stator cover 440, and the mover 430 may be coupled into the through-portion 442.

A back cover 450 may be coupled to the rear of the stator cover 440.

A front end portion of the back cover 450 may be fixedly coupled to a rear end portion of the stator cover 440.

A resonance spring 460 that expands and contracts along the axial direction may be disposed at the front of the back cover 450.

The resonance spring 460 may be provided in plurality.

The plurality of resonance springs 460 may include a first resonance spring 4601 and a second resonance spring 4602 spaced apart from each other in the axial direction.

A rear end portion of the second resonance spring 4602 may come in contact with the back cover 450.

A front end portion of the first resonance spring 4601 may come in contact with a rear end portion of the mover 430.

A rear region of the compression unit 200 may be supported by a rear elastic support portion 470.

The rear elastic support portion 470 may be coupled to the back cover 450. Accordingly, a rear end portion of the compression unit 200 can be buffered and supported by the rear elastic support portion 470.

The rear elastic support portion 470 may be provided with a spring 471.

The spring 471 may be formed, for example, in a disk shape.

A plurality of coupling portions 472 may be formed at an outer edge of the spring 471.

The spring 471 may include a plurality of elastically-deformable portions each extending spirally toward the center.

A central region of the spring 471 may be coupled to a suction guide 475.

The suction guide 475 may be fixedly coupled to the case 110 (a rear cover 125).

A flow path through which gas (refrigerant) is sucked may be defined through an inside (center) of the suction guide 475 in the axial direction.

The flow path of the suction guide 475 may communicate with the suction pipe 130.

Gas introduced into the suction guide 475 through the suction pipe 130 may be accommodated in an accommodating space defined inside the case 110.

The piston 230 may be implemented in a cylindrical shape with one side closed. A head 232 may be provided on one end portion (front end portion) of the piston 230. The head 232 may be provided with suction ports 234 through which refrigerant is sucked. The head 232 may be provided with a suction valve 235 for opening and closing the suction ports 234. The suction valve 235 may have, for example, a central region coupled to the head 232 of the piston 230 by a fixing member 236. The suction valve 235 may be configured to open the suction ports 234 when the piston 230 moves to a bottom dead center, and to close the suction ports 234 when the piston 230 moves to a top dead center.

A compression space 220 may be defined at one side in the cylinder 210.

In this implementation, the compression space 220 may be defined in the front end portion of the cylinder 210.

A discharge valve 215 for selectively opening and closing the compression space 220 may be disposed at the front end portion of the cylinder 210.

The discharge valve 215 may, for example, open and close the front end portion (front opening) of the cylinder 210. In this implementation, the front opening of the cylinder 210 may be referred to as a discharge port 212 in that compressed gas is discharged when the discharge valve 215 is open.

The discharge valve 215 may include, for example, a valve 217 in a disk shape, and a discharge valve spring 218 elastically supporting the valve 217.

The discharge valve spring 218 may be provided with a plurality of elastically-deformable portions formed in a disk shape and extending spirally from an outer edge toward a center. The plurality of elastically-deformable portions may be elastically deformable in the axial direction.

The center of the discharge valve spring 218 may be coupled to the valve 217. Accordingly, the valve 217 may be elastically supported in the axial direction.

The discharge valve spring 218 can allow the valve 217 to be brought into contact with the front end portion of the cylinder 210 so as to close the front opening of the cylinder 210.

The discharge valve spring 218 may open the discharge port 212 (the front opening) of the cylinder 210 when internal pressure of the compression space 220 of the cylinder 210 reaches preset pressure.

Here, the discharge valve spring 218 may have elastic force smaller than the preset pressure of the compression space 220. Accordingly, when the internal pressure of the compression space 220 reaches the preset pressure, the valve 217 may be elastically deformed in a direction away from the cylinder 210 along the axial direction to open the discharge port 212, so that compressed refrigerant can be discharged through the discharge port 212.

Meanwhile, a suction muffler 260 may be disposed at a rear region of the piston 230. The suction muffler 260, for example, may be formed substantially in a cylindrical shape. One end portion (front end portion) of the suction muffler 260 may be integrally coupled to the rear end portion of the piston 230. Accordingly, when the piston 230 reciprocates, the suction muffler 260 can also reciprocate.

An inner space of the suction muffler 260 may be divided into a plurality of spaces in the axial direction. The divided spaces may communicate with each other through guides 264.

A discharge cover assembly 500 may be disposed at the front of the compression space 220.

The discharge cover assembly 500 may include a discharge cover 510, and a first plenum 600 and a second plenum 700 both disposed inside the discharge cover 510.

A front elastic support portion 300 may be disposed at the front of the discharge cover assembly 500.

The front elastic support portion 300 may include a spring 310 coupled to the discharge cover 510.

The spring 310 may have a disk shape. An outer rim 314 of the spring 310 may be fixedly coupled to a fixing piece 122 provided inside the case 110. A fixing member 126 may be screwed into the outer rim 314 and the fixing piece 122 such that the outer rim 314 and the fixing piece 122 can be coupled to each other.

The spring 310 may include a plurality of elastically-deformable portions extending spirally from the outer rim 314 toward a center. The center of the spring 310 may be coupled to a support guide 545 coupled to the discharge cover 510. Accordingly, a front region of the compression unit 200 can be elastically supported by the spring 310.

A movement guide 550 for guiding the movement of the front end portion (the discharge cover 510) of the compression unit 200 may be disposed at the front region of the compression unit 200.

The movement guide 550 may include, for example, an inner guide 551 connected to an end portion of the discharge cover 510, and an outer guide 552 disposed outside the inner guide 551.

The inner guide 551 may be formed in a shape of a cap with one side open.

The outer guide 552 may be formed in a shape of a cap with one side open.

The inner guide 551 may be coupled to the support guide 545 so that its open end portion faces forward. The inner guide 551 may be coupled to the support guide 545 by a fixing member 553. This implementation illustrates the case where the inner guide 551 is coupled to the support guide 545 coupled to the discharge cover 510, but this is merely illustrative and the present disclosure may not be limited to this.

The outer guide 552 may be coupled to the front end portion (the front cover 125) of the case 110 so that its open end portion faces rearward. The outer guide 552 may be welded on the cover 125, for example.

With this configuration, when the front region (the support guide 545) of the compression unit 200 excessively moves in a horizontal direction with respect to the axial direction (in the radial direction of the case 110), an outer circumferential surface of the inner guide 551 may be brought into contact with an inner circumferential surface of the outer guide 552 so as to suppress the movement. Accordingly, the compression unit 200 can be suppressed from excessively moving in the radial direction with respect to the center of the case 110.

Figure 3:
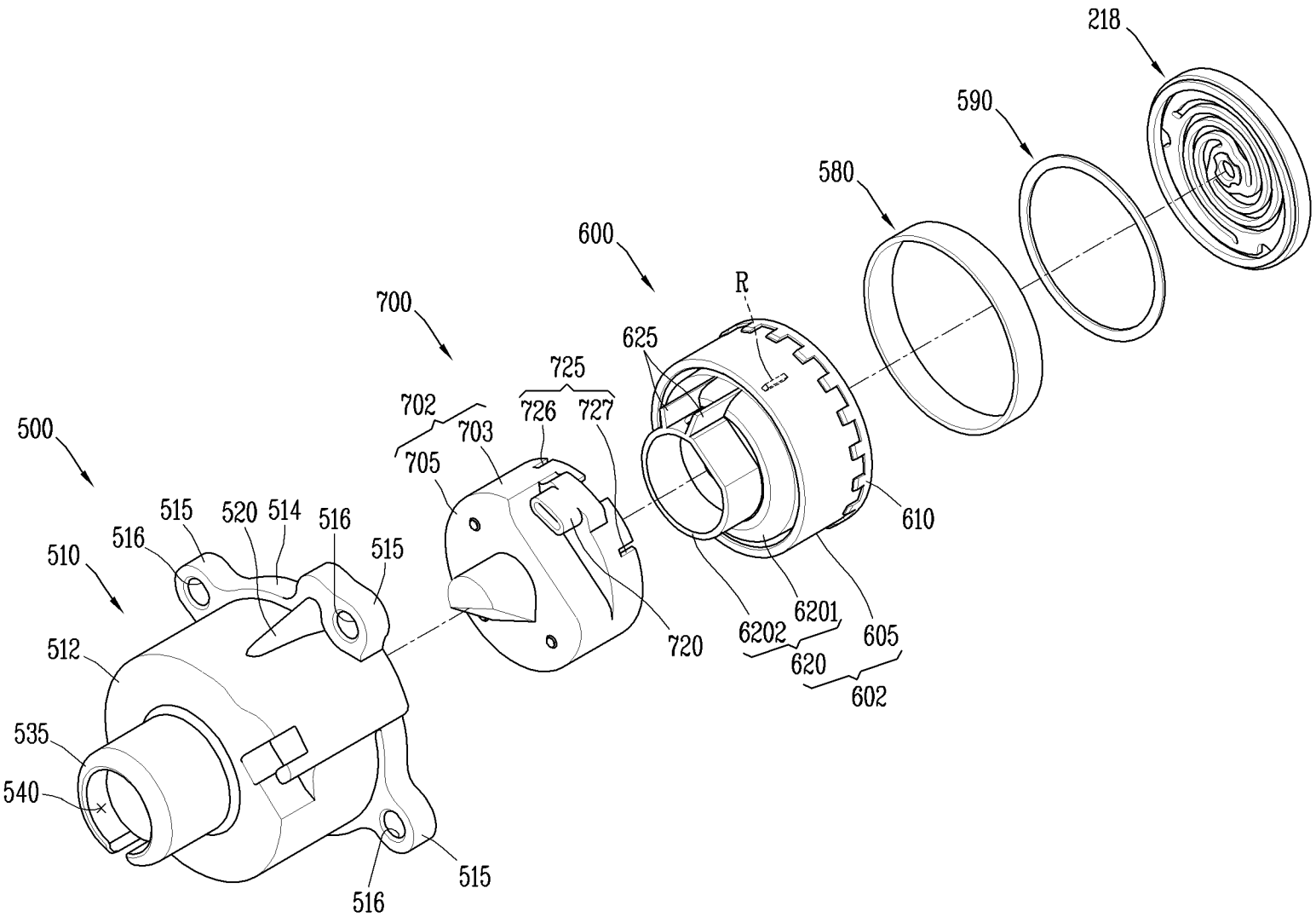
FIG. 3 is an exploded perspective view illustrating a discharge cover assembly of FIG. 2.
Figure 4:
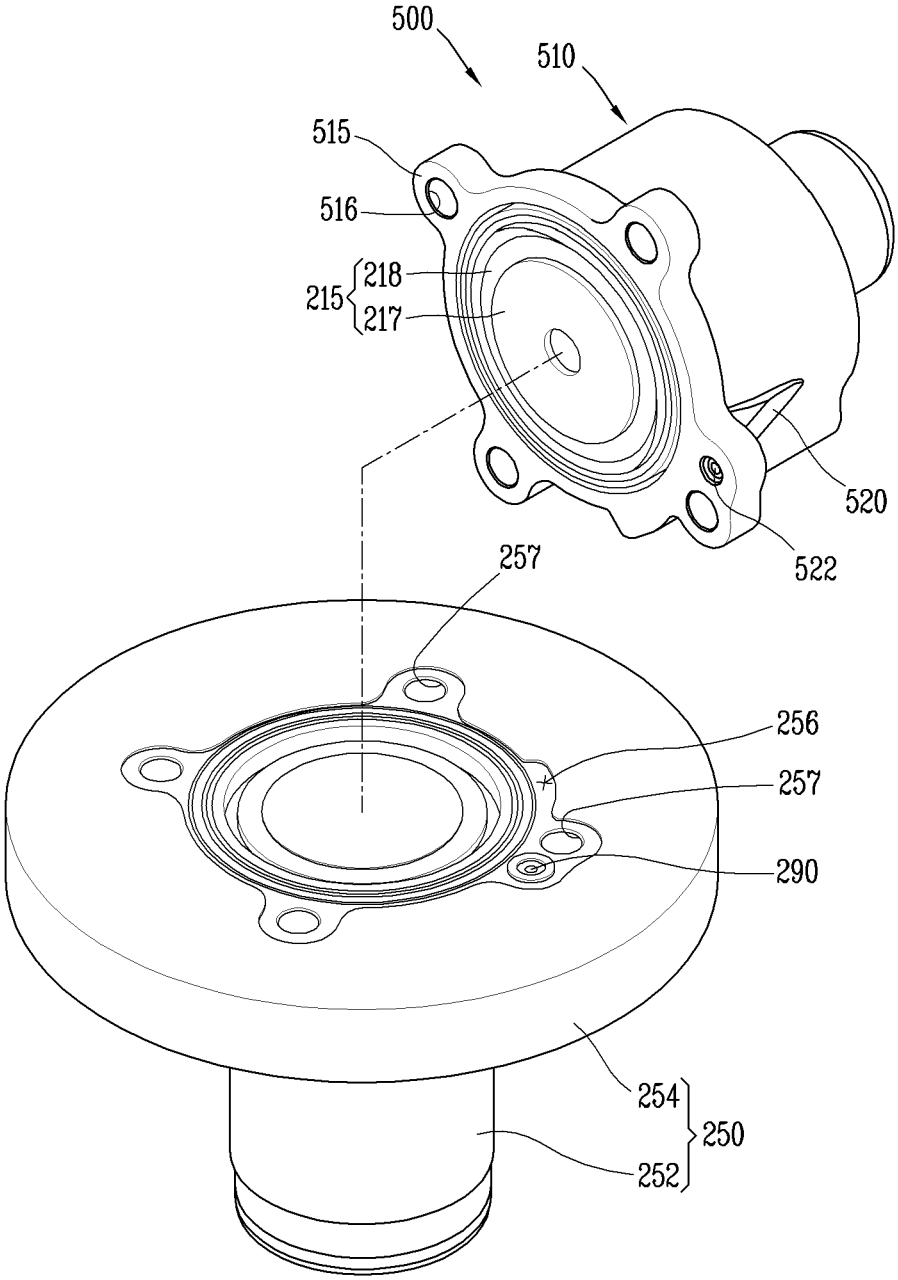
FIG. 4 is an exploded perspective view illustrating a frame and the discharge cover assembly of FIG. 2.

FIG. 3 is an exploded perspective view illustrating a discharge cover assembly of FIG. 2 and FIG. 4 is an exploded perspective view illustrating a frame and the discharge cover assembly of FIG. 2. As illustrated in FIG. 3, the discharge cover assembly 500 may include the discharge cover 510, and the first plenum 600 and the second plenum 700 both disposed inside the discharge cover 510.

The discharge cover 510 may define an inner accommodating space with one side open. One end portion (front end portion) of the discharge cover 510 may come in contact with the frame 250.

The discharge cover 510 may be provided with a flange portion 514 extending in the axial direction.

The flange portion 514 of the discharge cover 510 may come in contact with the flange portion 254 of the frame 250.

The discharge cover 510 (the flange portion 514) may be provided with a plurality of coupling portions 515 to be coupled to the frame 250. Insertion holes 516 may be formed through the plurality of coupling portions 515, respectively, such that coupling members (not illustrated) can be inserted.

A movement path 522 of refrigerant (gas) serving as a gas bearing may be defined in the discharge cover 510. An inclined portion 520 inclined with respect to the axial direction may be formed on an outer surface of the discharge cover 510. The movement path 522 of the refrigerant may be defined in the inclined portion 520.

The first plenum 600 and the second plenum 700 may be coupled into the discharge cover 510 in the axial direction.

The discharge cover assembly 500 may be provided with a fixing ring 580.

The fixing ring 580 may be disposed between the first plenum 600 and the discharge cover 510 in the radial direction. An inner surface of the fixing ring 580 may come in contact with an outer surface of the first plenum 600 and an outer surface of the fixing ring 580 may come in contact with an inner surface of the discharge cover 510. Accordingly, the first plenum 600 can be firmly fixed in the discharge cover 510.

The discharge cover assembly 500 may be provided with a damper 590.

The damper 590 may be implemented as a buffering member.

The damper 590 may be disposed between the first plenum 600 and the discharge valve 215 in the axial direction.

More specifically, the damper 590 may be disposed between a first inner wall 6201 of the first plenum 600 to be explained later and the discharge valve spring 218 in the axial direction. Accordingly, vibration of the discharge valve spring 218 can be suppressed from being transferred to the first plenum 600.

With this configuration, the discharge valve 215 can be coupled into the first plenum 600 with the damper 590 interposed therebetween.

The first plenum 600 and the second plenum 700 may be coupled to each other in the axial direction, and the first plenum 600 may be inserted into the discharge cover 510 with the fixing ring 580 interposed therebetween, thereby constituting the discharge cover assembly 500.

As illustrated in FIG. 4, the flange portion 254 of the frame 250 may be provided with a discharge cover coupling portion 256 to which the flange portion 514 of the discharge cover 510 is coupled.

The discharge cover coupling portion 256 may be recessed to correspond to a shape of the flange portion 514 of the discharge cover 510 such that the flange portion 514 of the discharge cover 510 can be inserted by a preset depth in the axial direction. The discharge cover coupling portion 256 may be provided with a plurality coupling member coupling portions 257 to which coupling members inserted through the discharge cover 510 can be coupled. The plurality of coupling member coupling portions 257 may have female screw portions to which the coupling members are screwed, respectively.

The flange portion 254 (the discharge cover coupling portion 256) may include a movement path 290 of refrigerant that communicates with the movement path 522 of the refrigerant (gas) defined in the discharge cover 510. Accordingly, the refrigerant of the discharge cover 510 can be moved to the frame 250 through the movement paths 522 and 290 that communicate with each other. The movement path 290 of the refrigerant defined in the flange portion 254 may extend into the body portion 252 and a refrigerant inlet 292 may be formed between the body portion 252 and the cylinder 210.

A nozzle 294 for spraying refrigerant onto an inner surface of the cylinder 210 may be disposed at the refrigerant inlet 292.

Figure 5:
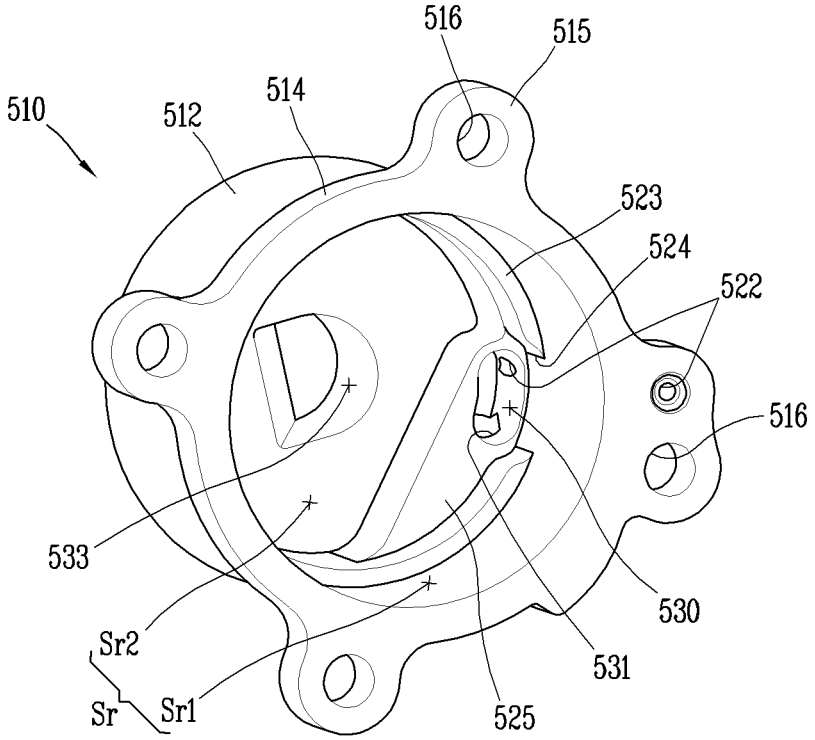
FIG. 5 is a view illustrating an inside of a discharge cover of FIG. 2.
Figure 6:
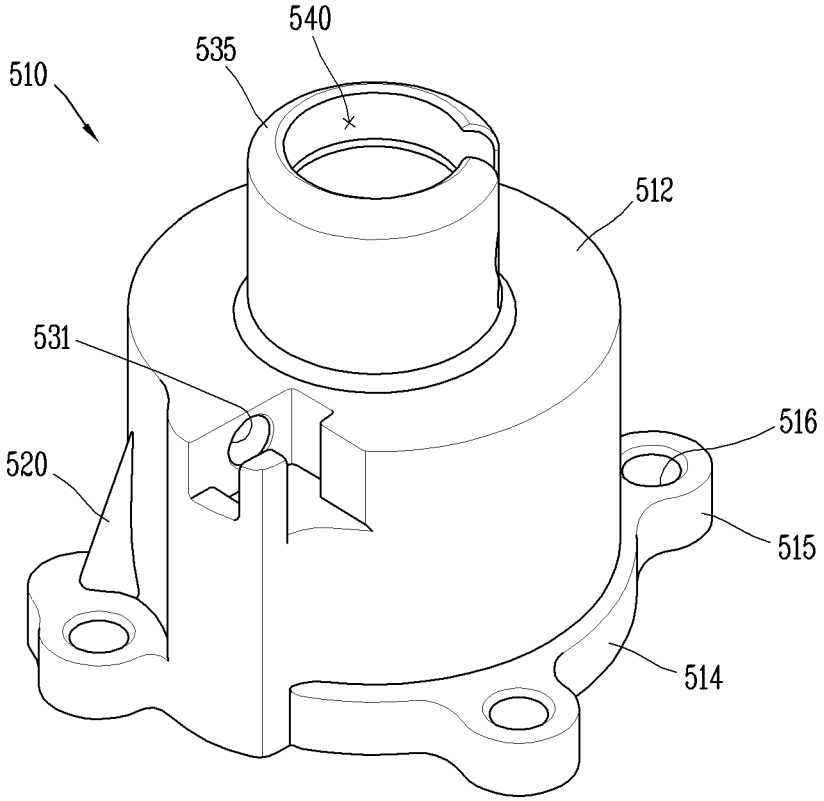
FIG. 6 is a view illustrating an outside of the discharge cover of FIG. 5.

FIG. 5 is a view illustrating an inside of a discharge cover of FIG. 2 and FIG. 6 is a view illustrating an outside of the discharge cover of FIG. 5. As illustrated in FIGS. 5 to 6, the discharge cover 510 may be formed substantially in a cylindrical shape. The discharge cover 510 may include a discharge cover body 512 having a cylindrical shape. An accommodating space Sr having one side open may be defined in the discharge cover body 512. The discharge cover 510 may be made of, for example, an aluminum member. The discharge cover 510 may be formed of, for example, a synthetic resin member to suppress internal thermal energy from being transmitted to outside.

Here, refrigerant inside a discharge space Sd in the discharge cover 510 may have relatively high pressure and temperature because the refrigerant has been discharged after being compressed in the compression space 220. On the other hand, refrigerant in the case 110 may have relatively low pressure and temperature because the refrigerant has been passed through an evaporator (not illustrated). When thermal energy of the refrigerant inside the discharge cover 510 is transferred to the refrigerant inside the case 110 at the outside of the discharge cover 510, temperature of refrigerant before being sucked into the compression space 220 may rise, which may lower compression efficiency (operation efficiency) of the compression unit 200.

In consideration of this point, in the compressor of this implementation, the discharge cover assembly 500 may be configured such that the accommodation space Sr is defined in the discharge cover 510 and the first plenum 600 and the second plenum 700 are inserted into the accommodating space Sr of the discharge cover 510. Accordingly, thermal energy of compressed refrigerant that is discharged from the compression space 220 and moves along the inside of the discharge cover assembly 500 can be suppressed from being transferred to the refrigerant (before being compressed) that exists outside the discharge cover assembly 500 in the case 110. This can prevent operation efficiency (compression efficiency) of the compressor from being lowered due to an increase in temperature of the refrigerant before being compressed.

The accommodating space Sr may include, for example, a first accommodating space Sr1 in which the first plenum 600 is accommodated and a second accommodating space Sr2 in which the second plenum 700 is accommodated.

The first accommodating space Sr1 may be defined at an opening side (rear region) of the discharge cover 510 and the second accommodating space Sr2 may be defined at a front region (far from the opening) of the first accommodating space Sr1.

The second accommodating space Sr2 may have a reduced inner diameter compared to the first accommodating space Sr1. A second plenum contact portion 523 may protrude from an inner surface of the discharge cover in the radial direction to be in close contact with an outer surface of the second plenum 700. A cutout portion 524 may be formed on the second plenum contact portion 523 so that an outlet portion 720 of the second plenum 700 to be described later can be inserted.

A stepped portion 525 that is stepped inward to correspond to an outer shape of the second plenum 700 may be disposed in the second accommodating space Sr2.

A concave portion 533 that is concavely recessed in one side (front) in the axial direction may be disposed in the second accommodating space Sr2.

A discharge groove 530 that is recessed in the axial direction may be formed in the stepped portion 525. A discharge hole 531 through which inside and outside of the discharge groove 530 communicate with each other may be formed through one side of the discharge groove 530. A movement path 522 through which refrigerant (gas) is to move to the cylinder 210 may be defined through another side of the discharge groove 530. An inlet-side end portion of the refrigerant movement path 522 may communicate with the discharge groove 530 and an outlet-side end portion thereof may be defined through the flange portion 514.

As illustrated in FIG. 6, a protruding portion 535 may protrude from an outer center of the discharge cover 510 in the axial direction. The concave portion 533 may be defined in the protruding portion 535. A support guide coupling portion 540 to which the support guide 545 is to be coupled may be formed in the protruding portion 535. The support guide coupling portion 540 may be recessed in the axial direction.

The discharge hole 531 may be formed through one side of the protruding portion 535. The discharge hole 531 may communicate with one end portion of a loop pipe 285 having another end portion communicating with the discharge pipe 135. The loop pipe 285 may have a structure bent a plurality of times. Accordingly, vibration of the discharge cover assembly 500 can be suppressed from being transferred to the discharge pipe 135.

Figure 7:
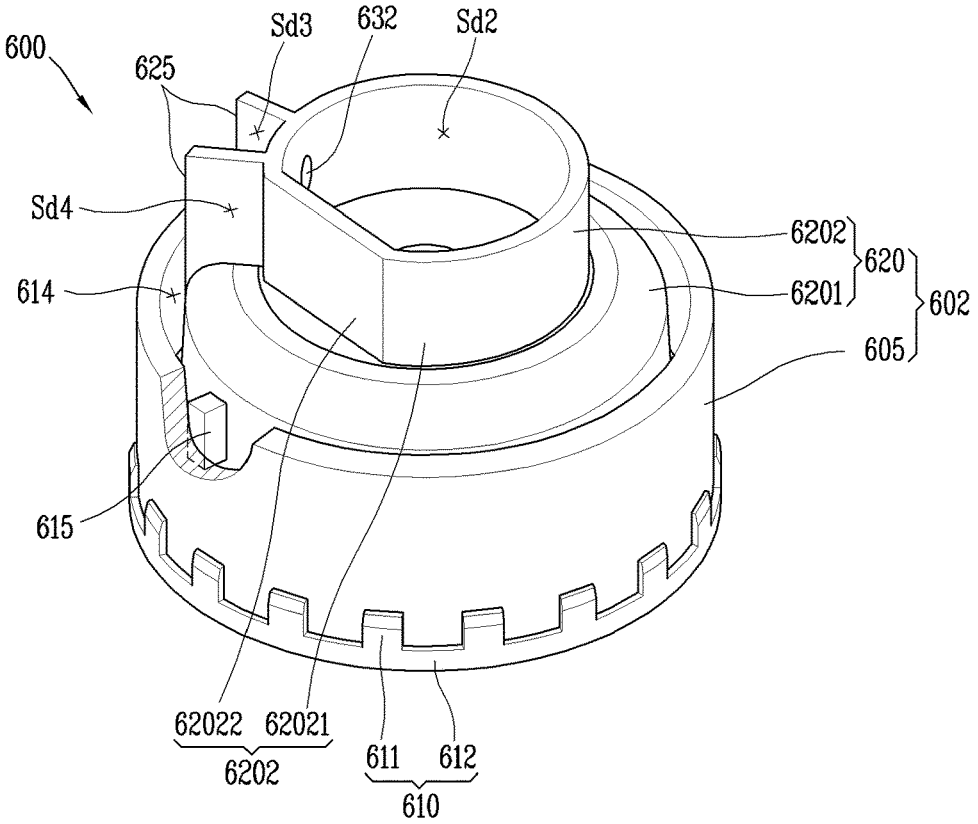
FIG. 7 is a view illustrating an outside of a first plenum of FIG. 2.
Figure 8:
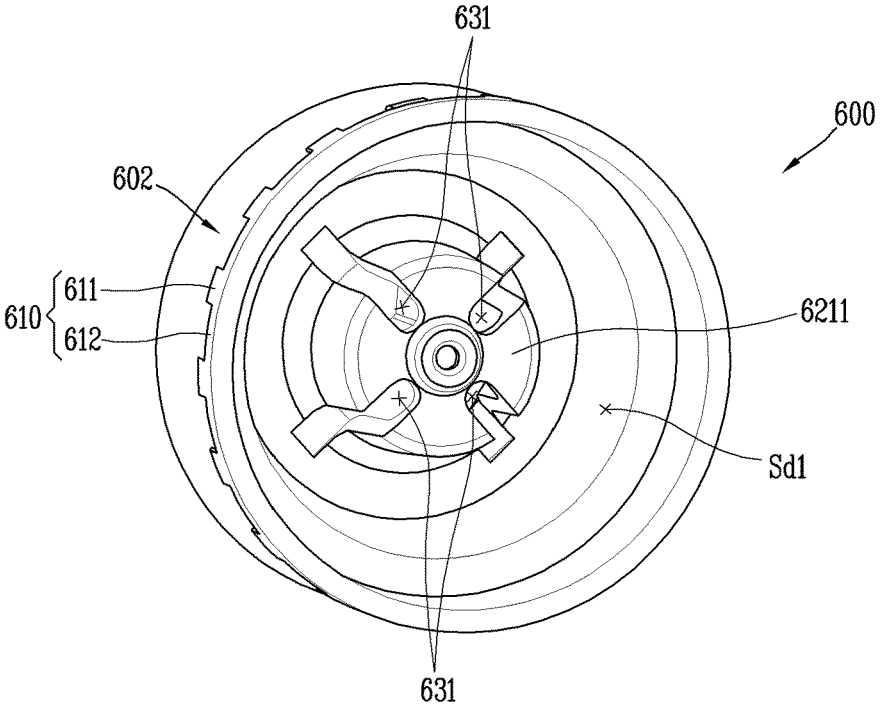
FIG. 8 is a view illustrating an inside of the first plenum of FIG. 7.
Figure 9:
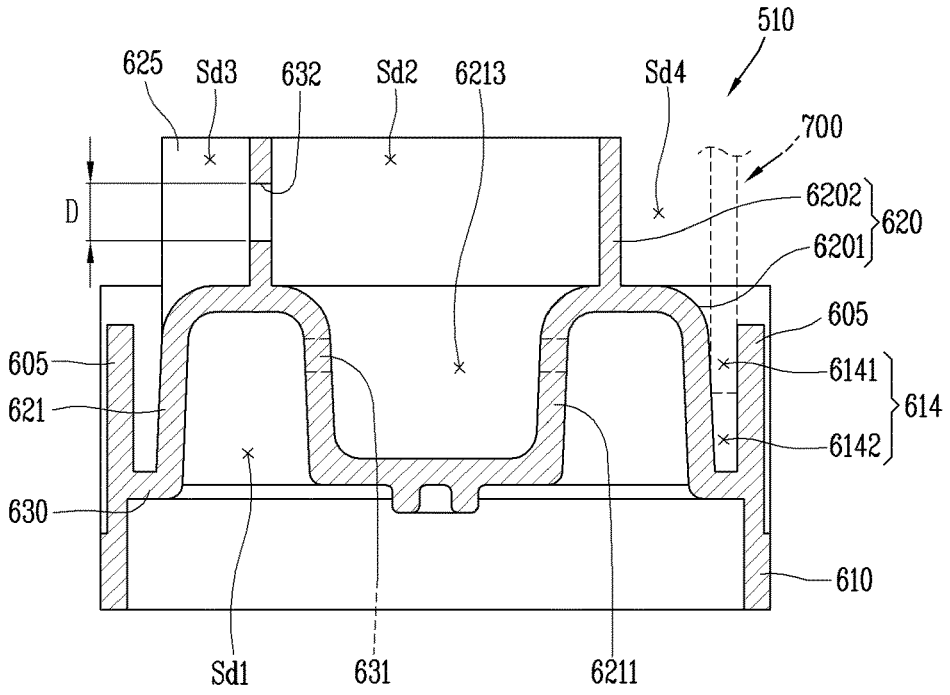
FIG. 9 is a cross-sectional view illustrating a second discharge hole region of FIG. 7.

FIG. 7 is a view illustrating an outside of a first plenum of FIG. 2, FIG. 8 is a view illustrating an inside of the first plenum of FIG. 7, and FIG. 9 is a cross-sectional view illustrating a second discharge hole region of FIG. 7. As illustrated in FIGS. 7 and 8, the first plenum 600 may be formed substantially in a cylindrical shape. The first plenum 600 may include a first plenum body 602 having a cylindrical shape. The first plenum 600 may be formed, for example, of an aluminum member. The first plenum 600 may be formed of, for example, a synthetic resin member to suppress heat transfer.

A discharge space Sd communicating with the compression space 220 may be defined inside the first plenum 600 and the second plenum 700.

The first plenum 600 may include a coupling space 614 that is partitioned from the discharge space Sd and disposed outside the discharge space Sd.

The coupling space 614 may be formed with one side (upper side in the drawing, namely, a front side of the first plenum 600) open in the axial direction.

The first plenum 600 (the first plenum body 602) may include an outer wall 605 in a cylindrical shape and an inner wall 620 formed in a cylindrical shape at an inner side of the outer wall 605.

A contact portion 610 may protrude in the radial direction from an outer surface of the outer wall 605 to be in close contact with an inner surface of the discharge cover 510. Accordingly, when the first plenum 600 is coupled into the discharge cover 510, the first plenum 600 and the discharge cover 510 can be firmly coupled to each other in the close contact state by the contact portion 610.

The contact portion 610 may include, for example, an annular portion 611, and a plurality of protrusions 612 protruding from the annular portion 611 in the axial direction and spaced apart from one another in the circumferential direction.

The inner wall 620 may be disposed at the inner side of the outer wall 605 in a radially spaced manner.

The outer wall 605 and the inner wall 620 may be spaced apart from each other in the radial direction and concentrically disposed with each other.

An end portion of the outer wall 605 and an end portion of the inner wall 620 may be connected by a connecting portion 630. One end portion (outer end portion) of the connecting portion 630 may be connected to an inner surface of the outer wall 605, and another end portion (inner end portion) may be connected to an outer surface of the inner wall 620.

The coupling space 614 may be defined between the outer wall 605 and the inner wall 620.

More specifically, the coupling space 614 may be defined as a space surrounded by the outer wall 605, the inner wall 620, and the connecting portion 630.

The coupling space 614 may be configured such that a region of an end portion (a front end portion of the outer wall 605) opposite to the connecting portion 630 is opened in the axial direction. A rear end portion of the second plenum 700 may be inserted (press-fitted) by a preset depth through the opening of the coupling space 614. When the first plenum 600 and the second plenum 700 are coupled, the front opening of the coupling space 614 may be blocked by the rear end portion of the second plenum 700. At this time, the rear end portion of the second plenum 700 may be inserted into the coupling space 614 by a depth of about a half length of the coupling space 614 in the axial direction, other than a depth of an entire length of the coupling space 614.

In the implementation, in the coupling space 614, a space (region) remaining after the rear end portion of the second plenum 700 is inserted may define a movement channel 6142 through which refrigerant moves.

Here, in the coupling space 614, a space (region) in which the rear end portion of the second plenum 700 is inserted may be referred to as an insertion portion 6141.

That is, the coupling space 614 may include the insertion portion 6141 and the movement channel 6142.

The movement channel 6142 may communicate with the discharge space Sd by a communication portion 725 to be described later. Accordingly, refrigerant in the discharge space Sd can move to the movement channel 6142 through the communication portion 725.

More specifically, the coupling space 614 may substantially have a rectangular cross-section with a length from the front end portion of the outer wall 605 of the first plenum 600 to the connecting portion 630 along the axial direction, and a width (length) between the inner surface of the outer wall 605 and the outer surface of the inner wall 620 (a first inner wall 6201 to be explained later).

The movement channel 6142 may have a rectangular cross-section excluding a length (depth) from an inlet of the coupling space 614 to an end portion (rear end portion) of the second plenum 700 inserted in the axial direction.

The inner wall 620 may include a first inner wall 6201 disposed at an inner side of the outer wall 605 and a second inner wall 6202 protruding from the first inner wall 6201 in the axial direction.

The first inner wall 6201 may be formed in a cylindrical shape with one side (a lower side in the drawing, facing the cylinder 210) open. A first discharge space Sd1 may be defined at an inner side of the first inner wall 6201. The first discharge space Sd1 may communicate with the compression space 220.

A protruding portion 6211 may protrude backward from a center of the first inner wall 6201 in the axial direction.

The first discharge space Sd1 may be defined in a tube shape between an inner surface of the first inner wall 6201 and an outer surface of the protruding portion 6211.

A space portion 6213 may be defined inside the protruding portion 6211. The space portion 6213 may be open forward. The space portion 6213 may communicate with a second discharge space Sd2 that is defined at an inner side of the second inner wall 6202.

More specifically, the second discharge space Sd2 may include all of a space defined at the inner side of the second inner wall 6202, the space portion 6213 defined inside the protruding portion 6211, and a space of the concave portion 707 of the second plenum 700 to be described later.

The discharge valve spring 218 may be coupled to the protruding portion 6211.

A first outlet hole 631 may be formed through the first inner wall 6201 (the protruding portion 6211) so that refrigerant can be discharged. The first outlet hole 631 may be provided in plurality. This implementation illustrates the case where the plurality of first outlet holes 631 are four, but this is merely illustrative and the present disclosure may not be limited to this.

The second inner wall 6202 may have a substantially cylindrical shape.

The second inner wall 6202 may have an outer diameter reduced compared to an outer diameter of the first inner wall 6201.

The second inner wall 6202 may have a front end portion open.

The front end portion of the second inner wall 6202 may be brought into close contact with the inner surface of the second plenum 700 when the second plenum 700 is coupled.

A second discharge space Sd2 may be defined at an inner side of the second inner wall 6202. The second discharge space Sd2 may communicate with the first discharge space Sd1. The second discharge space Sd2 may communicate with the first discharge space Sd1 through the first outlet holes 631. Accordingly, refrigerant in the first discharge space Sd1 can flow to the second discharge space Sd2 through the first outlet holes 631.

The second inner wall 6202 may include, for example, an arcuate section 62021 in an arcuate shape and a linear section 62022 in a linear shape. The linear section 62022 may be coupled to a side portion 711 formed in the axial direction on one side of a protruding portion 710 of the second plenum 700 to be described later. Accordingly, the second plenum 700 and the first plenum 600 can be coupled to each other at an accurate assembly position.

The first plenum 600 may include outflow guides 625 protruding radially from the outer surface of the second inner wall 6202. The outflow guides 625 may be implemented as a pair spaced apart from each other along the circumferential direction of the first plenum 600, for example. Outer end portions of the outflow guides 625 in the radial direction of the first plenum 600 may be brought into contact with the inner surface of the second plenum 700 when the second plenum 700 is coupled. End portions (upper end portions in FIG. 7) of the outflow guides 625 may be brought in contact with the inner surface of the second plenum 700.

A third discharge space Sd3 may be defined at an inner side of the outflow guides 625.

A fourth discharge space Sd4 may be defined at an outer side of the outflow guides 625.

Here, the inner side of the outflow guides 625 may mean a space corresponding to the closest distance of distances between the two outflow guides 625 in the circumferential direction of the first plenum 600. The outer side of the outflow guides 625 may mean a space corresponding to the farthest distance of the distances between the two outflow guides 625 in the circumferential direction of the first plenum 600. The third discharge space Sd3 may be partitioned from the fourth discharge space Sd4 by the outflow guides 625 and the inner surface of the second plenum 700.

More specifically, when the second plenum 700 and the first plenum 600 are coupled to each other, the outflow guides 625 may be brought into contact with the inner surface of the second plenum 700, so that the third discharge space Sd3 can be defined between one region in the second plenum 700 and the inner side of the outflow guides 625 and the fourth discharge space Sd4 can be defined between another region in the second plenum 700 and the outer side of the outflow guides 625.

The third discharge space Sd3 may communicate with the second discharge space Sd2.

A second outlet hole 632 may be provided at the second inner wall 6202 such that the second discharge space Sd2 and the third discharge space Sd3 can communicate with each other.

As illustrated in FIG. 9, the second outlet hole 632 may be formed through the second inner wall 6202. Here, a cross-sectional area of the second outlet hole 632 may be the same as, for example, a cross-sectional area of the movement channel 6142. Also, the cross-sectional area of the second outlet hole 632 may be the same as, for example, the sum of cross-sectional areas of the first outlet holes 631. This configuration can suppress an occurrence of flow resistance of refrigerant due to a difference in flow cross-sectional area of the refrigerant when the refrigerant is moved.

Meanwhile, a rib 615 may be disposed inside the coupling space 614 of the first plenum 600.

The rib 615 may block the movement channel 6142, for example.

One end portion (lower end portion in the drawing) of the rib 615 may be connected to the connecting portion 630. An outer surface of the rib 615 in the radial direction of the first plenum 600 may be connected to the outer wall 605 and an inner surface of the rib 615 may be connected to the inner wall 620. Another end portion (upper end portion in the drawing) of the rib 615 may come in contact with the end portion of the second plenum 700. Accordingly, refrigerant in the movement channel 6142 can move only in a direction without passing through the rib 615.

Figure 10:
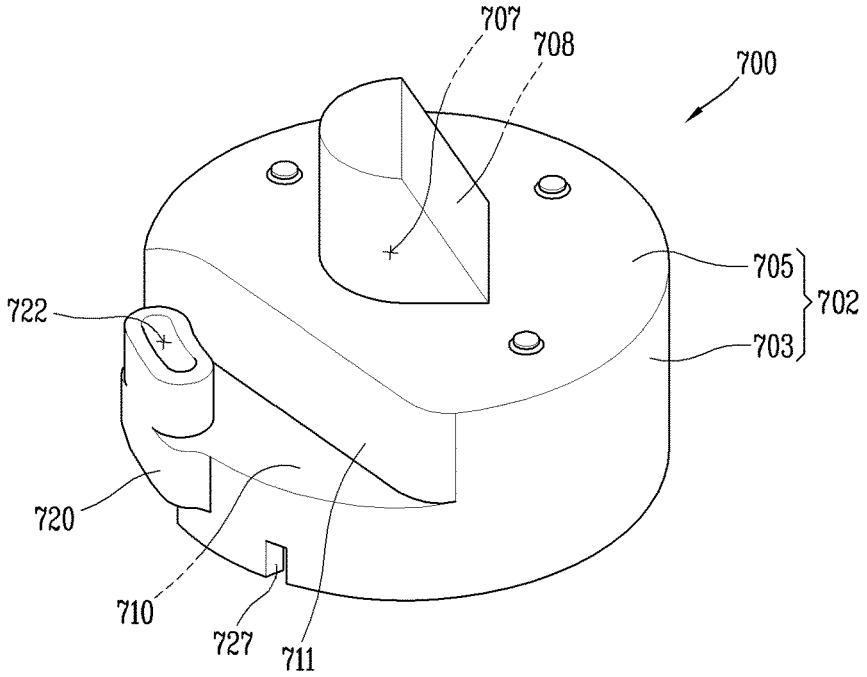
FIG. 10 is a view illustrating an outside of a second plenum of FIG. 2.
Figure 11:
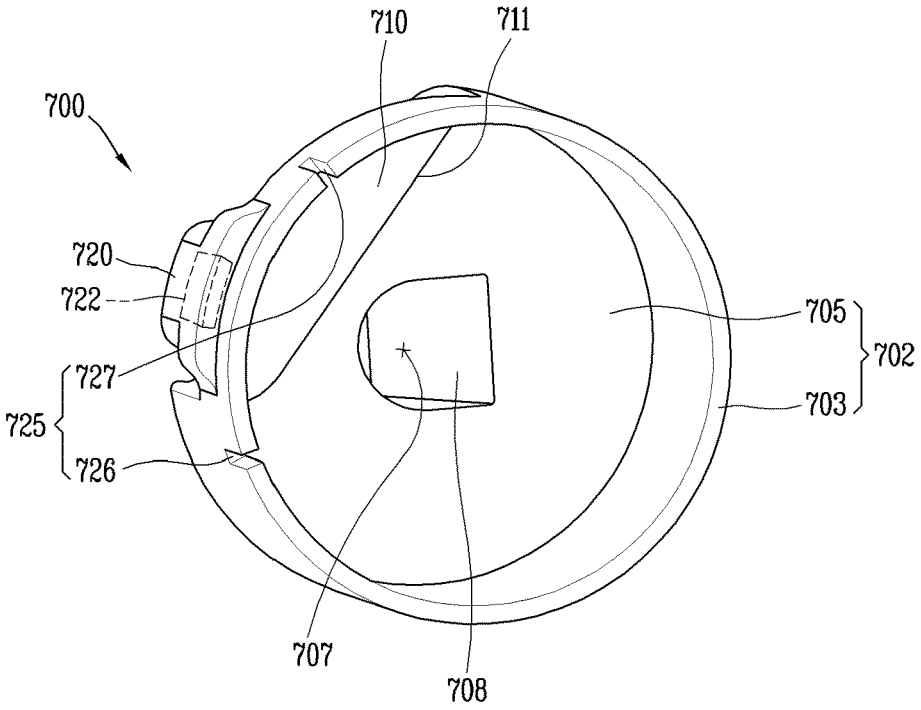
FIG. 11 is a view illustrating an inside of the second plenum of FIG. 10.

FIG. 10 is a view illustrating an outside of a second plenum of FIG. 2 and FIG. 11 is a view illustrating an inside of the second plenum of FIG. 10. As illustrated in FIGS. 10 and 11, the second plenum 700 may be formed substantially in a cylindrical shape. The second plenum 700 may include a second plenum body 702 having a cylindrical shape. The second plenum body 702 may have an accommodating space therein. The second plenum 700 may be formed, for example, of an aluminum member. The second plenum 700 may be formed of, for example, a synthetic resin member to suppress internal thermal energy to outside.

The second plenum 700 may have a cylindrical shape with one side closed.

The second plenum 700 may have an outer diameter slightly smaller than a maximum outer diameter of the first plenum 600.

The second plenum 700 may be inserted into the coupling space 614 in the axial direction. The second plenum 700 may be press-fitted to the coupling space 614.

More specifically, an outer circumferential surface of the second plenum 700 may be brought into contact with an inner circumferential surface of the outer wall 605 of the first plenum 600, and an inner circumferential surface of the second plenum 700 may be brought into contact with an outer circumferential surface of the inner wall 620 of the first plenum 600.

The second plenum body 702 may include a cylindrical portion 703 in a cylindrical shape and a blocking portion 705 blocking one end portion (front end portion) of the cylindrical portion 703.

A concave portion 707 may protrude outward from a center of the blocking portion 705 in the axial direction and have a recessed inside. The concave portion 707 may configure a part of the second discharge space Sd2. The concave portion 707 may have a substantially cylindrical shape. The concave portion 707 may have an inclined surface 708 that is inclined in the axial direction. The inclined surface 708 may be disposed at one region of the concave portion in the circumferential direction.

The second plenum 700 may include a protruding portion 710 that a portion (arcuate shape) of the blocking portion 705 protrudes inward (rearward) in the axial direction. A side portion 711 may be formed at one side of the protruding portion 710 in the axial direction.

The cylindrical portion 703 of the second plenum 700 may have one end portion (rear end portion) to be inserted into the coupling space 614 of the first plenum 600 by a preset depth.

On a circumferential surface of the cylindrical portion 703, an outlet portion 720 may protrude radially from an outer side of the protruding portion 710.

The outlet portion 720 may extend in the axial direction.

The outlet portion 720 may communicate with the discharge groove 530 of the discharge cover 510. When the second plenum 700 is inserted into the discharge cover 510, an end portion of the outlet portion 720 may be inserted into the discharge groove 530 of the discharge cover 510.

An outlet groove 722 may be formed through the outlet portion 720 in the axial direction. An inner end portion of the outlet groove 722 may be open inward through the inner surface of the cylindrical portion 703. Accordingly, refrigerant in the fourth discharge space Sd4 inside the second plenum 700 can move to the discharge groove 530 of the discharge cover 510 along the outlet groove 722.

The second plenum 700 may include a communicating portion 725 through which the discharge space Sd communicates with the movement channel 6142. The communicating portion 725 may be formed, for example, by cutting out a rear end portion of the cylindrical portion 703 of the second plenum 700 in the axial direction.

The communicating portion 725 may include an inlet 726 and an outlet 727 spaced apart from the rib 615 with the rib 615 interposed therebetween. This can define a movement path of refrigerant having a long length from the inlet 726 disposed adjacent to one side of the rib 615 to the outlet 727 disposed adjacent to another side of the rib 615 in the circumferential direction.

The inlet 726 and the outlet 727 may be formed by cutting out an end portion (the cylindrical portion 703) of the second plenum 700 by predetermined lengths in the axial direction. Here, when the cylindrical portion 703 of the second plenum 700 is inserted into the coupling space 614 of the first plenum 600, rear regions of the inlet 726 and the outlet 727 may be inserted into the coupling space 614 of the first plenum 600 to communicate with the movement channel 6142, respectively.

A front region of the inlet 726 may be disposed in the third discharge space Sd3.

A front region of the outlet 727 may be disposed in the fourth discharge space Sd4.

This implementation illustrates the case where the inlet 726 and the outlet 727 are formed through the cylindrical portion 703, respectively, but this is merely illustrative and may not be limited thereto. Alternatively, the inlet 726 and the outlet 727 may be respectively formed in a groove shape recessed in an inner surface of the cylindrical portion 703 in the radial direction.

When the second plenum 700 is inserted into the discharge cover 510, outer surfaces of the inlet 726 and the outlet 727 may be blocked by the inner surface of the discharge cover 510.

The inlet 726 and the outlet 727 may be located adjacent to the rib 615.

Accordingly, a movement path of refrigerant that flows along the inlet 726, the movement channel 6142, and the outlet 727 can have a relatively long length.

With this configuration, as the refrigerant in the third discharge space Sd3 moves along the inlet 726, the movement channel 6242, and the outlet 727, an acoustic equivalent mass can be remarkably increased.

The inlet 726 may communicate with the third discharge space Sd3.

Accordingly, the refrigerant in the third discharge space Sd3 can be introduced into the movement channel 6142 through the inlet 726.

The outlet 727 may communicate with the fourth discharge space Sd4.

Accordingly, the refrigerant moved along the movement channel 6142 can flow into the fourth discharge space Sd4 through the outlet 727.

Here, a cross-sectional area of the inlet 726 and a cross-sectional area of the outlet 727 may be substantially the same as a flow cross-sectional area of the movement channel 6142.

This can result in suppressing an increase in flow resistance of refrigerant due to a difference of a flow cross-sectional area during the movement of refrigerant.

Figure 12:
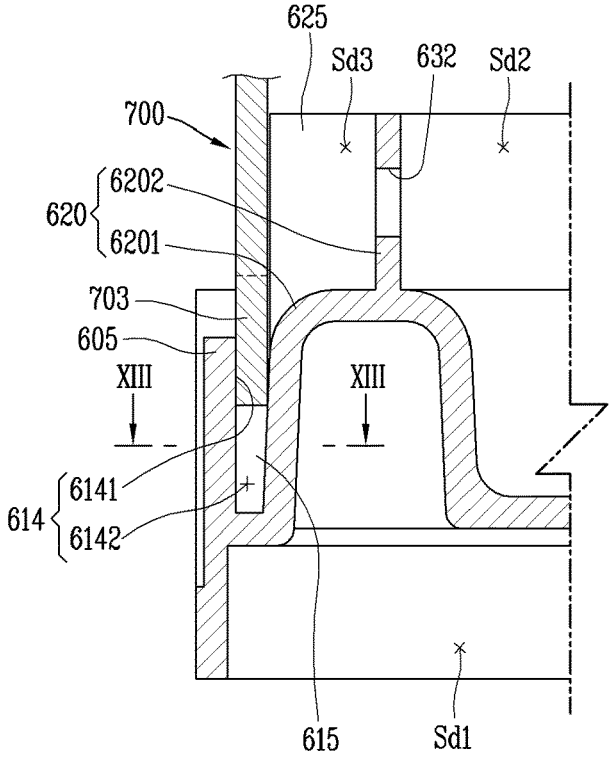
FIG. 12 is an enlarged view illustrating a coupling region between the first plenum and the second plenum of FIG. 2.
Figure 13:
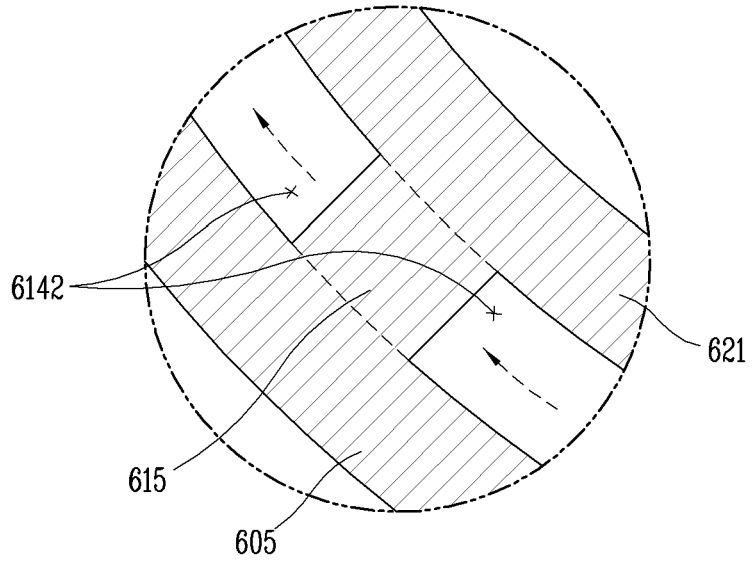
FIG. 13 is a planar sectional view illustrating a rib region of FIG. 12.
Figure 14:
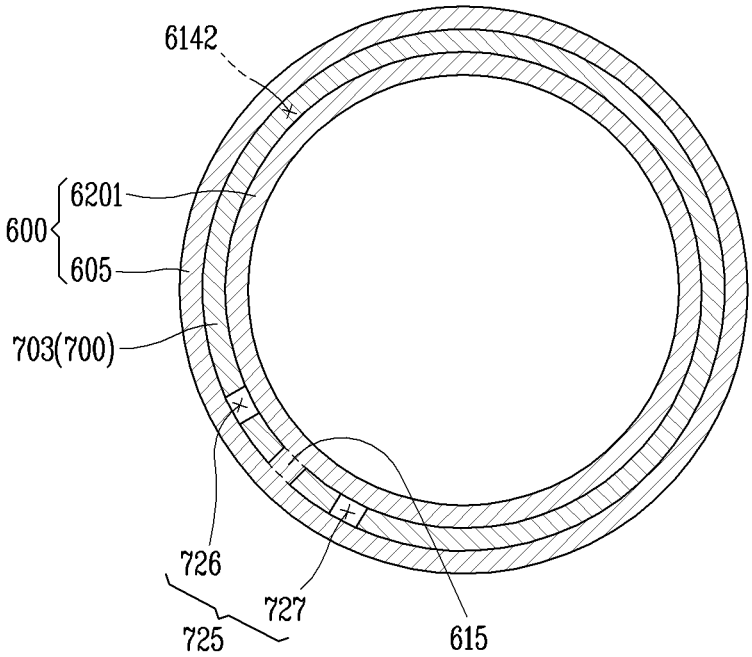
FIG. 14 is a planar sectional view illustrating the coupling region between the first plenum and the second plenum of FIG. 12.
Figure 15:
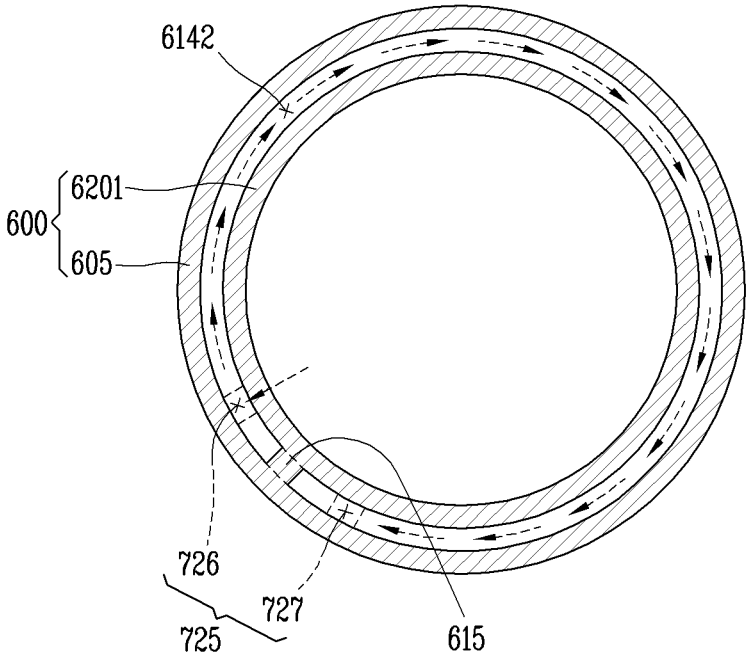
FIG. 15 is a view illustrating a refrigerant movement along a movement channel of FIG. 14.

FIG. 12 is an enlarged view illustrating a coupling region between the first plenum and the second plenum of FIG. 2, FIG. 13 is a planar sectional view illustrating a rib region of FIG. 12, FIG. 14 is a planar sectional view illustrating the coupling region between the first plenum and the second plenum of FIG. 12, and FIG. 15 is a view illustrating a refrigerant movement along a movement channel of FIG. 14. As illustrated in FIG. 12, the rear end portion of the second plenum 700 may be inserted by a preset depth into the front end portion of the first plenum 600 in the axial direction.

The rear end portion of the second plenum 700 may be brought into contact with the front end portion (upper end portion in the drawing) of the rib 615.

As illustrated in FIG. 13, the movement channel 6142 may be defined at both sides of the rib 615.

As illustrated in FIG. 14, the inlet 726 may be disposed at one side of the rib 615 and the outlet 727 may be disposed at another side of the rib 615.

With this configuration, as illustrated in FIG. 15, the refrigerant in the third discharge space Sd3 can be introduced into one end portion of the movement channel 6142 through the inlet 726 and move along the movement channel 6142 in one direction (clockwise direction in the drawing) of the circumferential direction. The refrigerant moved along the movement channel 6142 can move to the fourth discharge space Sd4 through the outlet 727.

Figure 16:
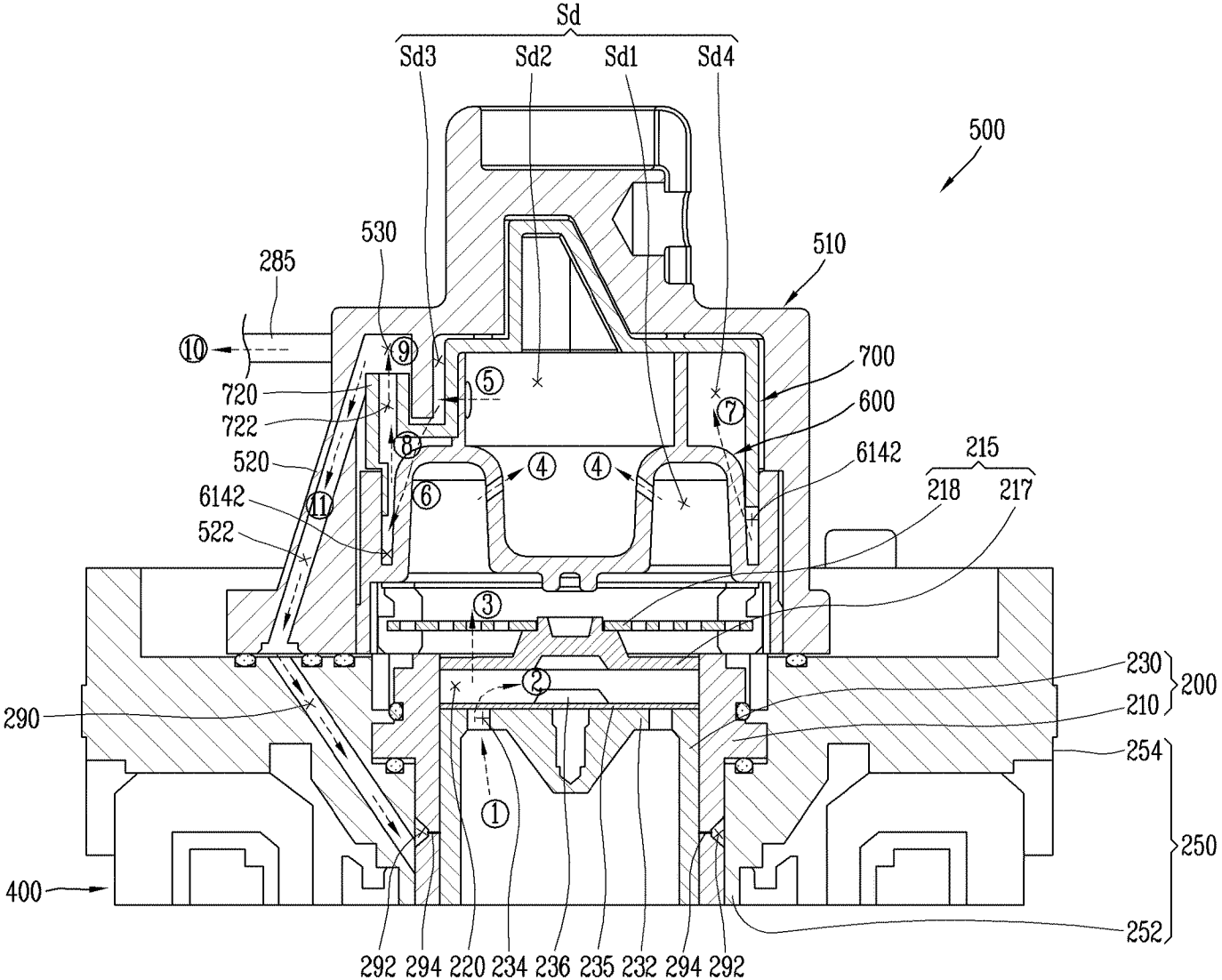
FIG. 16 is a view illustrating a refrigerant movement in the discharge cover of FIG. 2.
Figure 17:
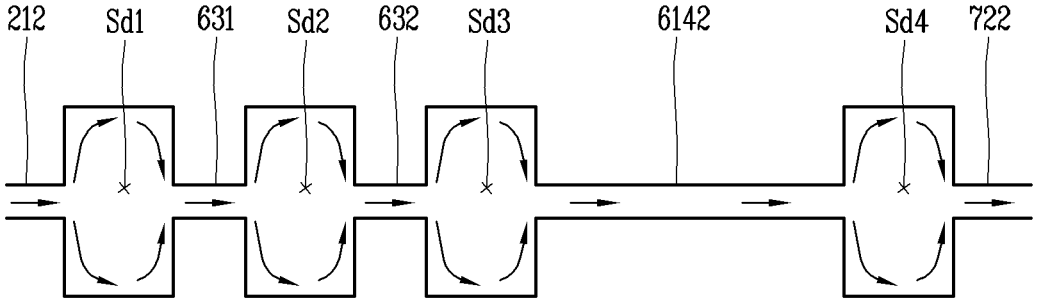
FIG. 17 is a diagram illustrating a refrigerant movement inside the discharge cover of FIG. 16.

FIG. 16 is a view illustrating a refrigerant movement in the discharge cover of FIG. 2 and FIG. 17 is a diagram illustrating a refrigerant movement inside the discharge cover of FIG. 16.

Hereinafter, suction, compression and discharge strokes of refrigerant in the compressor according to the implementation will be described with reference to FIGS. 2, 16 and 17.

When power is applied to the stator coil 416, a magnetic field generated by the stator coil 416 and a magnetic field generated by the permanent magnets 432 may interact with each other, such that the mover 430 can reciprocate along the axial direction.

When the piston 230 moves to a bottom dead center, the suction valve 235 may open the suction ports 234, such that refrigerant inside the piston 230 can move into the compression space 220 through the suction ports 234.

When the piston 230 moves to a top dead center, the suction valve 235 may close the suction ports 234. Responsive to this, the refrigerant in the compression space 220 can be compressed. When internal pressure of the compression space 220 reaches preset pressure, the discharge valve spring 218 may open the discharge port 212 and thus the refrigerant compressed in the compression space 220 can be discharged into the first discharge space Sd1.

As illustrated in FIG. 16, the refrigerant in the first discharge space Sd1 may move to the second discharge space Sd2 through the plurality of first outlet holes 631. The refrigerant in the second discharge space Sd2 may move to the third discharge space Sd3 through the second outlet hole 632. The refrigerant in the third discharge space Sd3 may move to the movement channel 6142 through the inlet 726 and to the fourth discharge space Sd4 through the outlet 727.

The refrigerant moved to the fourth discharge space Sd4 can move to the discharge groove 530 along the outlet groove 722.

As illustrated in FIG. 17, the refrigerant moved (expanded) from the compression space 220 to the first discharge space Sd1 may be compressed while passing through the plurality of first outlet holes 631, and then expanded while moving to the second discharge space Sd2. The refrigerant in the second discharge space Sd2 may be compressed while passing through the second outlet hole 632 and expanded while moving to the third discharge space Sd3. The refrigerant in the third discharge space Sd3 may be compressed while moving along the inlet 726, the movement channel 6142, and the outlet 727. At this time, the refrigerant in the third discharge space Sd3 may be compressed while moving along the inlet 726, the movement channel 6142, and the outlet 727 and move by a relatively long length (distance), resulting in remarkably increasing an acoustic equivalent mass. Accordingly, pulsation can be remarkably mitigated and noise generation can be remarkably reduced. The refrigerant moved through the outlet 727 may be expanded in the fourth discharge space Sd4. The refrigerant in the fourth discharge space Sd4 may move to the discharge groove 530 through the outlet groove 722.

A part of the refrigerant moved into the discharge groove 530 may be discharged out of the case 110 through the discharge pipe 135 via the loop pipe 285 connected to the discharge groove 530.

Another part of the refrigerant moved to the discharge groove 530 may move into the refrigerant inlet 292 along the gas movement paths 522 and 290 that are defined in the discharge cover 510 and the frame 250. The refrigerant introduced into the refrigerant inlet 292 may be sprayed into a gap between an inner circumferential surface of the cylinder 210 and an outer circumferential surface of the piston 230 through the nozzle 294 communicating with the inside of the cylinder 210. Accordingly, friction between the inner circumferential surface of the cylinder 210 and the outer circumferential surface of the piston 230 can be reduced.

In the compressor according to the implementation, the refrigerant compressed in the compression space 220 may be repetitively expanded and compressed while passing through the plurality of discharge spaces Sd and the plurality of outlet holes 631 and 632, thereby reducing the pulsation. In particular, while the refrigerant passes through the movement channel 6142 that has a long length compared to its width (flow cross-sectional area), the acoustic equivalent mass can be remarkably increased and thus the pulsation can be remarkably reduced. This can lead to significant reduction of noise caused by the pulsation.

In addition, in the compressor of this implementation, the plurality of discharge spaces Sd and the outlet holes 631 and 632 may be disposed in the first plenum 600 and the second plenum 700 coupled to the inside of the discharge cover 510. Therefore, thermal energy of the compressed refrigerant of high temperature can be prevented from being transmitted to the outside of the discharge cover 510.

In consideration of this, when the discharge cover 510, the first plenum 600, and the second plenum 700 are formed of the synthetic resin member having a relatively low heat transfer coefficient, the thermal energy of the compressed refrigerant can be further prevented from being transmitted to the outside of the discharge cover 510.

Figure 18:
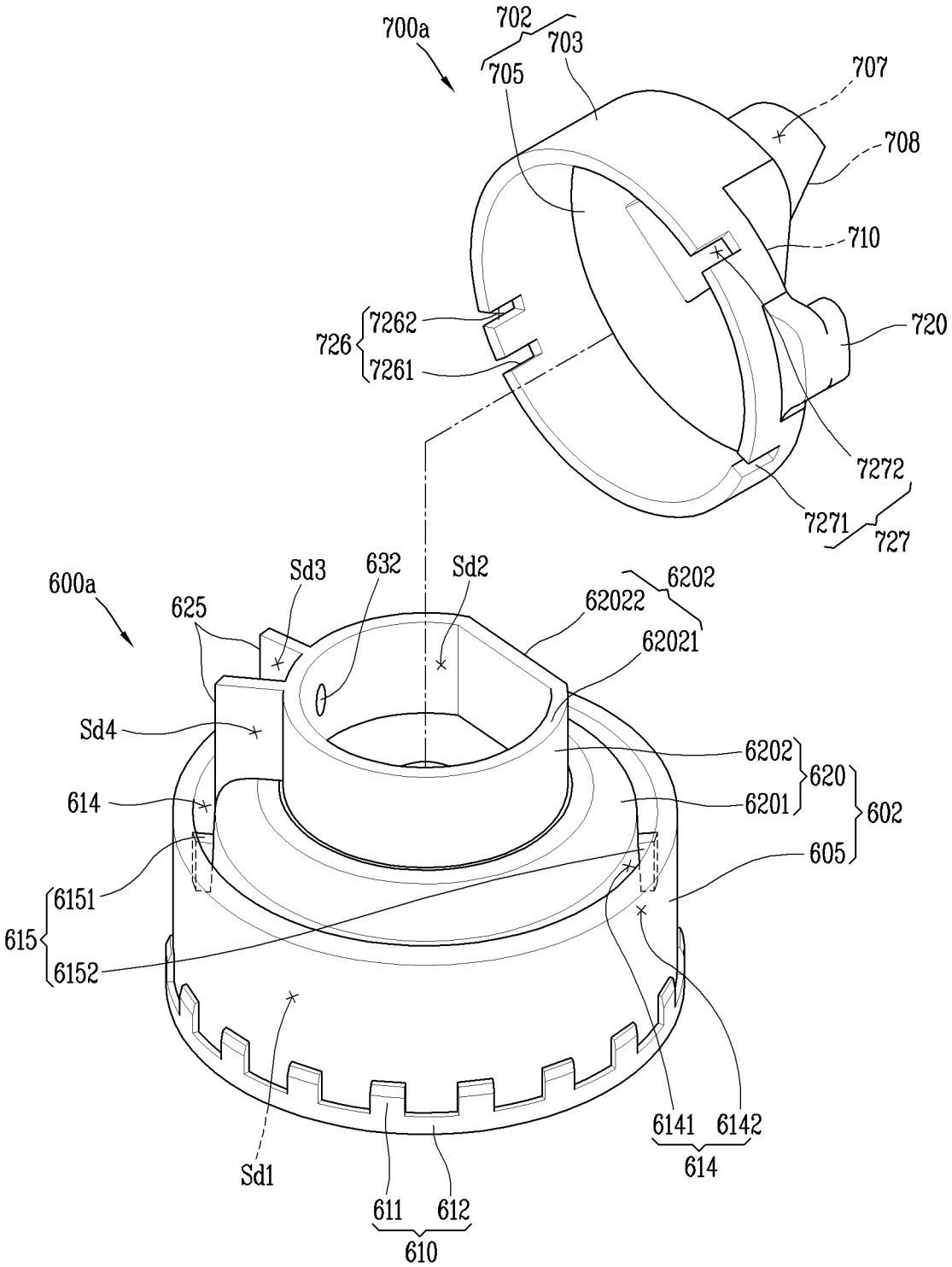
FIG. 18 is a perspective view illustrating a state before coupling a first plenum and a second plenum of a compressor in accordance with another implementation.
Figure 19:
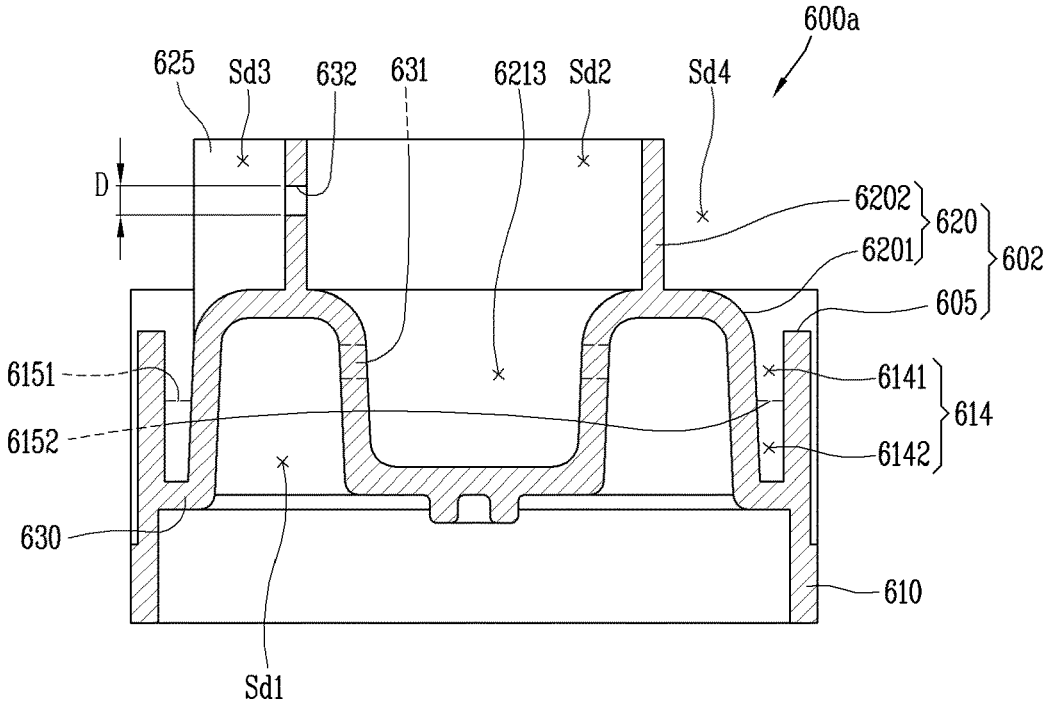
FIG. 19 is a cross-sectional view illustrating a second discharge hole region of the first plenum of FIG. 18.

FIG. 18 is a perspective view before coupling a first plenum and a second plenum of a compressor in accordance with another implementation and FIG. 19 is a cross-sectional view illustrating a second discharge hole region of the first plenum of FIG. 18. As described above, a compressor according to this implementation may include a case 110, a compression unit 200, and a driving unit 400.

The driving unit 400 may include, for example, a stator 410 and a mover 430 reciprocating with respect to the stator 410.

The compression unit 200 may include, for example, a cylinder 210 defining a compression space 220, and a piston 230 reciprocating with respect to the cylinder 210 in an axial direction.

The compression unit 200 may include a frame 250 disposed at an outer side of the cylinder 210.

The compression unit 200 may include a discharge cover 510 disposed at one side (front side) of the cylinder 210 to cover the compression space 220.

The discharge cover 510, as illustrated in FIG. 18, may include therein a first plenum 600*a* and a second plenum 700*a* defining a plurality of discharge spaces Sd communicating with the compression space 220.

The first plenum 600*a* and the second plenum 700*a* may be coupled to each other in the axial direction.

The first plenum 600*a* may include a coupling space 614 to which the first plenum 600*a* is coupled.

The first plenum 600*a* may include an outer wall 605 and an inner wall 620 concentrically disposed with the outer wall 605 to cooperatively define the coupling space 614.

The inner wall 620 may include a first inner wall 6201 disposed at an inner side of the outer wall 605 in a radial direction, and a second inner wall 6202 protruding from the first inner wall 6201 in an axial direction.

The second inner wall 6202 may include an arcuate section 62021 and a linear section 62022 linearly connecting both ends of the arcuate section 62021.

As illustrated in FIG. 19, the coupling space 614 may be defined between the outer wall 605 and the inner wall 620 (the first inner wall 6201). The coupling space 614 may be formed with one side (upper side in the drawing, namely, a front side of the first plenum 600*a*) open.

A protruding portion 6211 may protrude from a center of the first inner wall 6201 in the axial direction. A space portion 6213 may be defined inside the protruding portion 6211.

A first discharge space Sd1 may be defined at an inner side of the first inner wall 6201.

A second discharge space Sd2 may be defined at an inner side of the second inner wall 6202.

A first outlet hole 631 may be formed through the first inner wall 6201 such that refrigerant in the first discharge space Sd1 can flow to a second discharge space Sd2. The first outlet hole 631 may be provided in plurality.

Meanwhile, the first plenum 600*a* may include outflow guides 625 protruding from the second inner wall 6202 in the radial direction. The outflow guide 625 may be provided as a pair spaced apart in a circumferential direction.

A third discharge space Sd3 may be defined at an inner side of the outflow guides 625.

A fourth discharge space Sd4 may be defined at an outer side of the outflow guides 625.

A second outlet hole 632 may be disposed at the second inner wall 6202 such that refrigerant in the second discharge space Sd2 can flow outward. The second outlet hole 632 may be formed through the second inner wall 6202.

The second outlet hole 632 may be formed such that the second discharge space Sd2 and the third discharge space Sd3 can communicate with each other. The second outlet hole 632 may be formed through the second inner wall 6202 between the outflow guides 625 in the circumferential direction. Accordingly, the refrigerant in the second discharge space Sd2 can move to the third discharge space Sd3.

Meanwhile, a movement channel 6142 may be defined in the coupling space 614 of the first plenum 600*a* when the second plenum 700*a* is coupled.

The movement channel 6142 may be defined by the outer wall 605, the inner wall 620, and the connecting portion 630 of the first plenum 600*a* and an end portion (rear end portion) of the second plenum 700*a* blocking an inlet of the coupling space 614.

A rib 615 for dividing the movement channel 6142 may be disposed in the coupling space 614.

Accordingly, the refrigerant can move in one direction (a direction without passing through the rib 615) in the movement channel 6142.

The rib 615 may include, for example, a first rib 6151 and a second rib 6152 dividing the movement channel 6142 into two channels, namely, a first movement channel 61421 and a second movement channel 61422.

The first rib 6151 may be disposed, for example, at a region corresponding to the third discharge space Sd3.

More specifically, the first rib 6151 may be disposed between extension lines that extend in the radial direction from the outflow guides 625 and extend in the axial direction to partition (divide) the coupling space 614.

The second rib 6152 may be located at an inner point of the coupling space 614 (movement channel 6142) corresponding to the same length in both directions from the first rib 6151.

Accordingly, the first movement channel 61421 and the second movement channel 61422 partitioned by the first rib 6151 and the second rib 6152 can have the same length.

The second rib 6152 may be configured, for example, to be rotationally symmetrical with the first rib 6151 with respect to the center of the first plenum 600*a*.

Meanwhile, the second plenum 700*a* may have a substantially cylindrical shape. A protruding portion 710 may protrude inward from the second plenum 700*a* in the axial direction. A side portion 711 disposed at one side of the protruding portion 710 in the axial direction may face or come in contact with the linear section 62022 of the first plenum 600*a*.

The second plenum 700*a* may include a cylindrical portion 703 inserted into the coupling space 614 by a preset depth.

An outlet portion 720 may protrude from one side of the cylindrical portion 703 in the radial direction. An outlet groove 722 may be disposed in the outlet portion 720 to communicate with the fourth discharge space Sd4. The outlet groove 722 may communicate with the discharge groove 530 of the discharge cover 510.

Accordingly, the fourth discharge space Sd4 and an inner space of the discharge groove 530 can communicate with each other.

The second plenum 700*a* (the cylindrical portion 703) may include an inlet 726 through which the third discharge space Sd3 communicates with the movement channel 6142.

The inlet 726 may include a first inlet 7261 through which the third discharge space Sd3 and the first movement channel 61421 communicate with each other, and a second inlet 7262 through which the third discharge space Sd3 and the second movement channel 61422 communicate with each other.

The first inlet 7261 and the second inlet 7262 may be spaced apart from each other with the first rib 6151 interposed therebetween.

The first inlet 7261 and the second inlet 7262 may be formed at positions where those inlets can communicate with the third discharge space Sd3.

The second plenum 700*a* (the cylindrical portion 703) may include an outlet 727 communicating with the first movement channel 61421.

The outlet 727 may include a first outlet 7271 through which the first movement channel 61421 and the fourth discharge space Sd4 communicate with each other, and a second outlet 7272 through which the second movement channel 61422 and the fourth discharge space Sd4 communicate with each other.

The first outlet 7271 and the second outlet 7272 may be spaced apart from each other with the second rib 6152 interposed therebetween.

Figure 20:
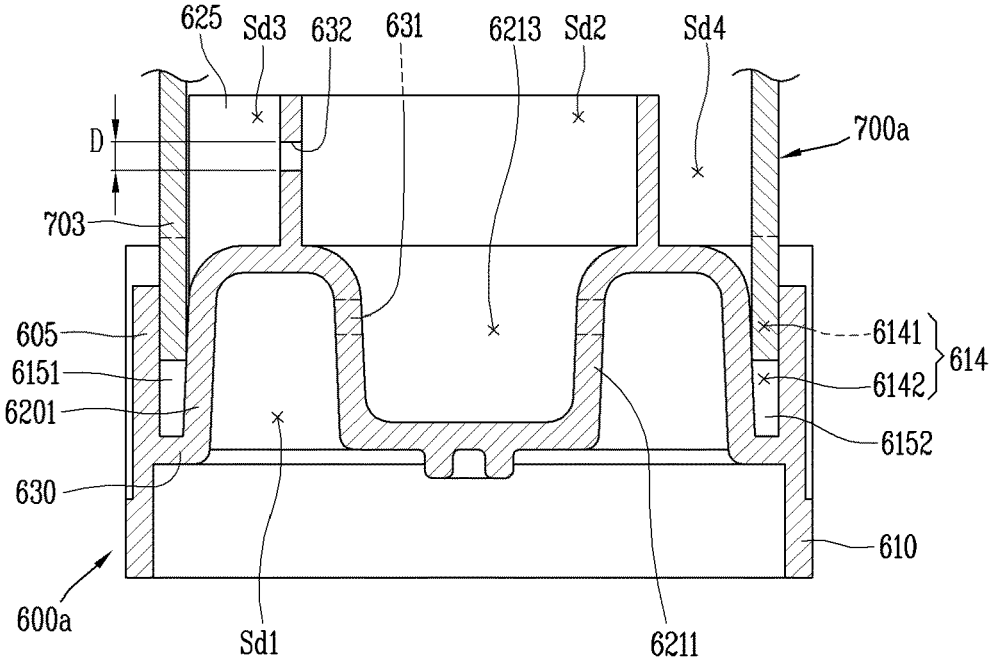
FIG. 20 is a cross-sectional view illustrating a coupling region between the first plenum and the second plenum of FIG. 18.

FIG. 20 is a cross-sectional view illustrating a coupling region between the first plenum and the second plenum of FIG. 18. As illustrated in FIG. 20, when the second plenum 700*a* is coupled to block the inlet of the coupling space 614 of the first plenum 600*a*, a lower end portion (rear end portion) of the second plenum 700*a* may be brought into contact with end portions of the first rib 6151 and the second rib 6152.

The first movement channel 61421 and the second movement channel 61422 partitioned from each other may be defined at both sides between the first rib 6151 and the second rib 6152, respectively.

Figure 21:
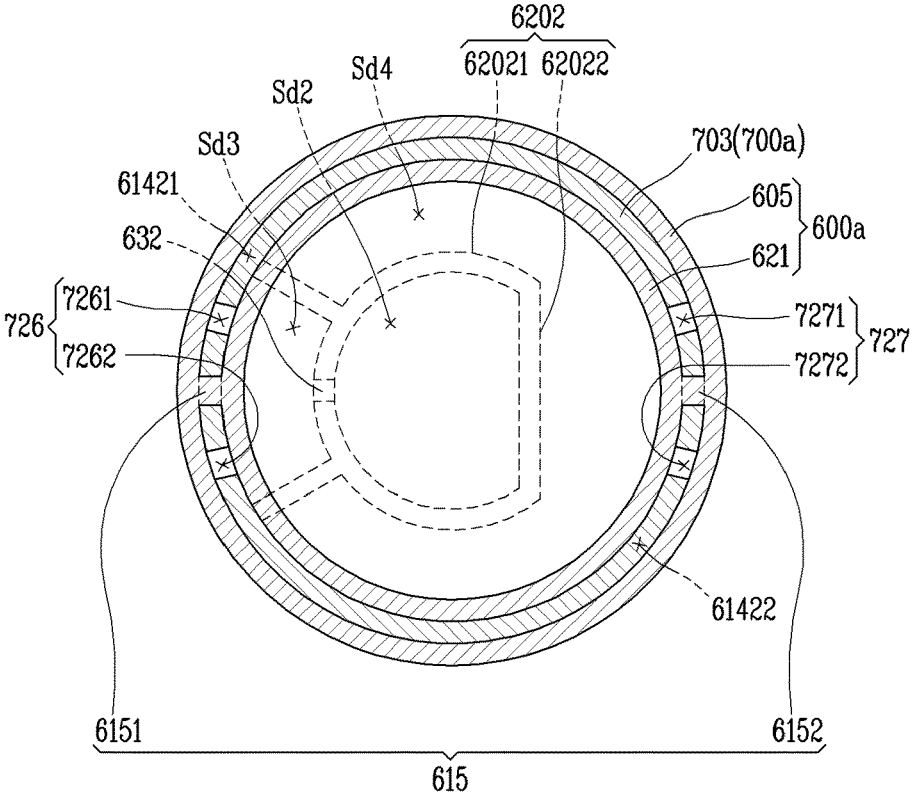
FIG. 21 is a planar sectional view illustrating the coupling region between the first plenum and the second plenum of FIG. 20.
Figure 22:
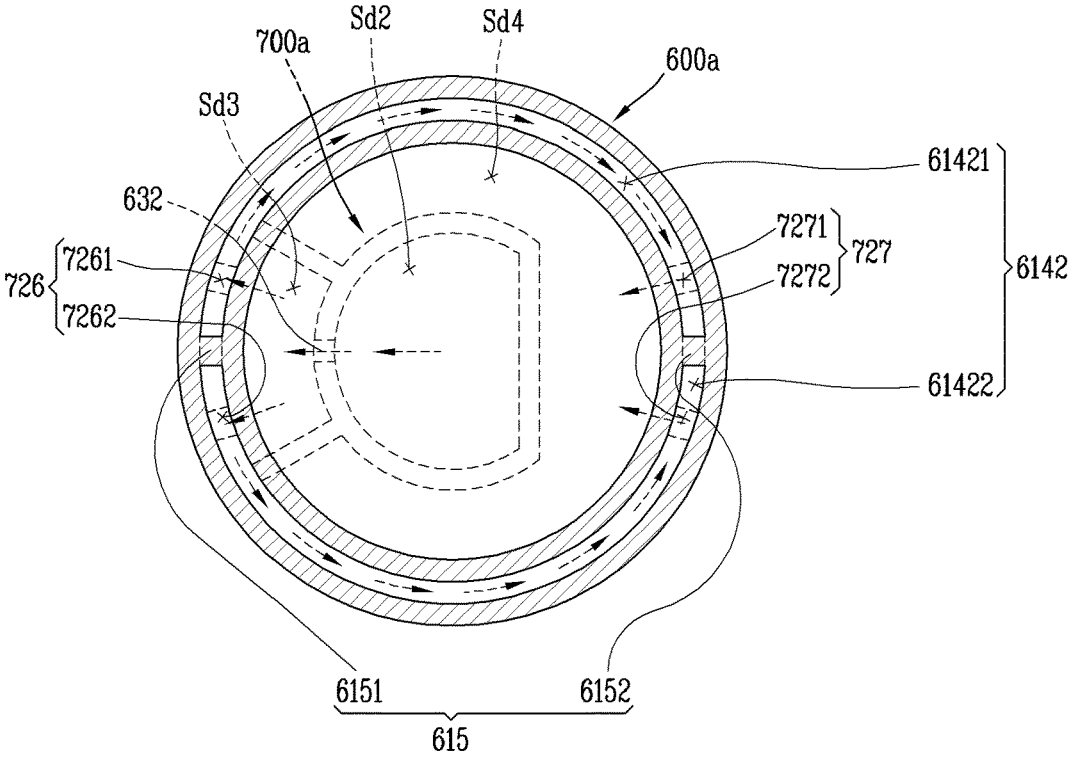
FIG. 22 is a view illustrating a refrigerant movement along a movement channel of FIG. 21.
Figure 23:
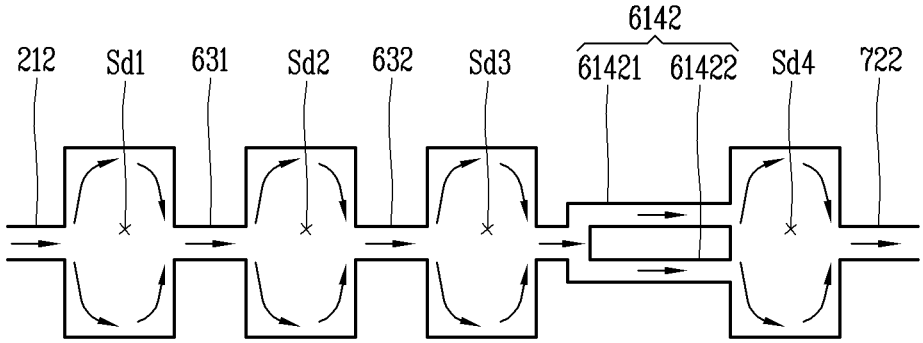
FIG. 23 is a diagram illustrating a refrigerant movement inside the discharge cover of FIG. 17.

FIG. 21 is a planar sectional view illustrating the coupling region between the first plenum and the second plenum of FIG. 20, FIG. 22 is a view illustrating a refrigerant movement along a movement channel of FIG. 21, and FIG. 23 is a diagram illustrating a refrigerant movement inside the discharge cover of FIG. 17. As illustrated in FIG. 21, the outer end portions of the outflow guides 625 may come in contact with the inner wall 620 of the second plenum 700*a*. The second discharge space Sd2 may be defined inside the first plenum 600*a* and the third discharge space Sd3 may be defined between (at the inner side of) the outflow guides 625. A fourth discharge space Sd4 may be defined at an outer side of the outflow guides 625.

The first rib 6151 may be disposed in the movement channel 6142 corresponding to the third discharge space Sd3 and the second rib 6152 may be disposed at an opposite side (180 degrees) of the first rib 6151.

Accordingly, the first movement channel 61421 and the second movement channel 61422 can be defined between the first rib 6151 and the second rib 6152.

The first inlet 7261 may communicate with the first movement channel 61421 and the second inlet 7262 may communicate with the second movement channel 61422.

The first outlet 7271 may communicate with the first movement channel 61421 and the second outlet 7272 may communicate with the second movement channel 61422.

With this configuration, as illustrated in FIGS. 22 and 23, refrigerant discharged from the compression space 220 to the first discharge space Sd1 can move to the second discharge space Sd2 through the first outlet holes 631 and refrigerant in the second discharge space Sd2 can move to the third discharge space Sd3 through the second outlet hole 632.

A part of refrigerant in the third discharge space Sd3 can be introduced into the first movement channel 61421 through the first inlet 7261. The refrigerant moved along the first movement channel 61421 can be introduced into the fourth discharge space Sd4 through the first outlet 7271.

Another part of the refrigerant in the third discharge space Sd3 can be introduced into the second movement channel 61422 through the second inlet 7262. The refrigerant moved along the second movement channel 61422 can be introduced into the fourth discharge space Sd4 through the second outlet 7272.

The refrigerant in the fourth discharge space Sd4 can move to the discharge groove 530 of the discharge cover 510 along the outlet groove 722.

A part of refrigerant moved into the discharge groove 530 can be discharged out of the case 110 through the discharge pipe 135 via the loop pipe 285.

Another part of the refrigerant moved to the discharge groove 530 can move along a gas movement path defined in the discharge cover 510, the frame 250, and the cylinder 210, so as to be sprayed into a gap between the inner circumferential surface of the cylinder 210 and the outer circumferential surface of the piston 230 through the nozzle of the cylinder 210. Accordingly, friction between the cylinder 210 and the piston 230 can be reduced.

In the compressor according to this implementation, refrigerant can be moved (expanded) from the compression space 220 to the first discharge space Sd1, compressed while passing through the first outlet holes 631, and then expanded to the second discharge space Sd2. The refrigerant in the second discharge space Sd2 can be compressed while passing through the second outlet hole 632, and expanded in the third discharge space Sd3. Through the repetitive compression and expansion, pulsation can be mitigated.

A part of the refrigerant in the third discharge space Sd3 can move through the first inlet 7261, the first movement channel 61421, and the first outlet 7271. During the movement, the acoustic equivalent mass can be significantly increased.

Another part of the refrigerant in the third discharge space Sd3 can move through the second inlet 7262, the second movement channel 61422, and the second outlet 7272. During the movement, the acoustic equivalent mass can be significantly increased. Accordingly, the pulsation can be remarkably mitigated and noise generation can be remarkably reduced. The refrigerant moved through the first outlet 7171 and the refrigerant moved through the second outlet 7272 each can be expanded in the fourth discharge space Sd4.

Figure 24:
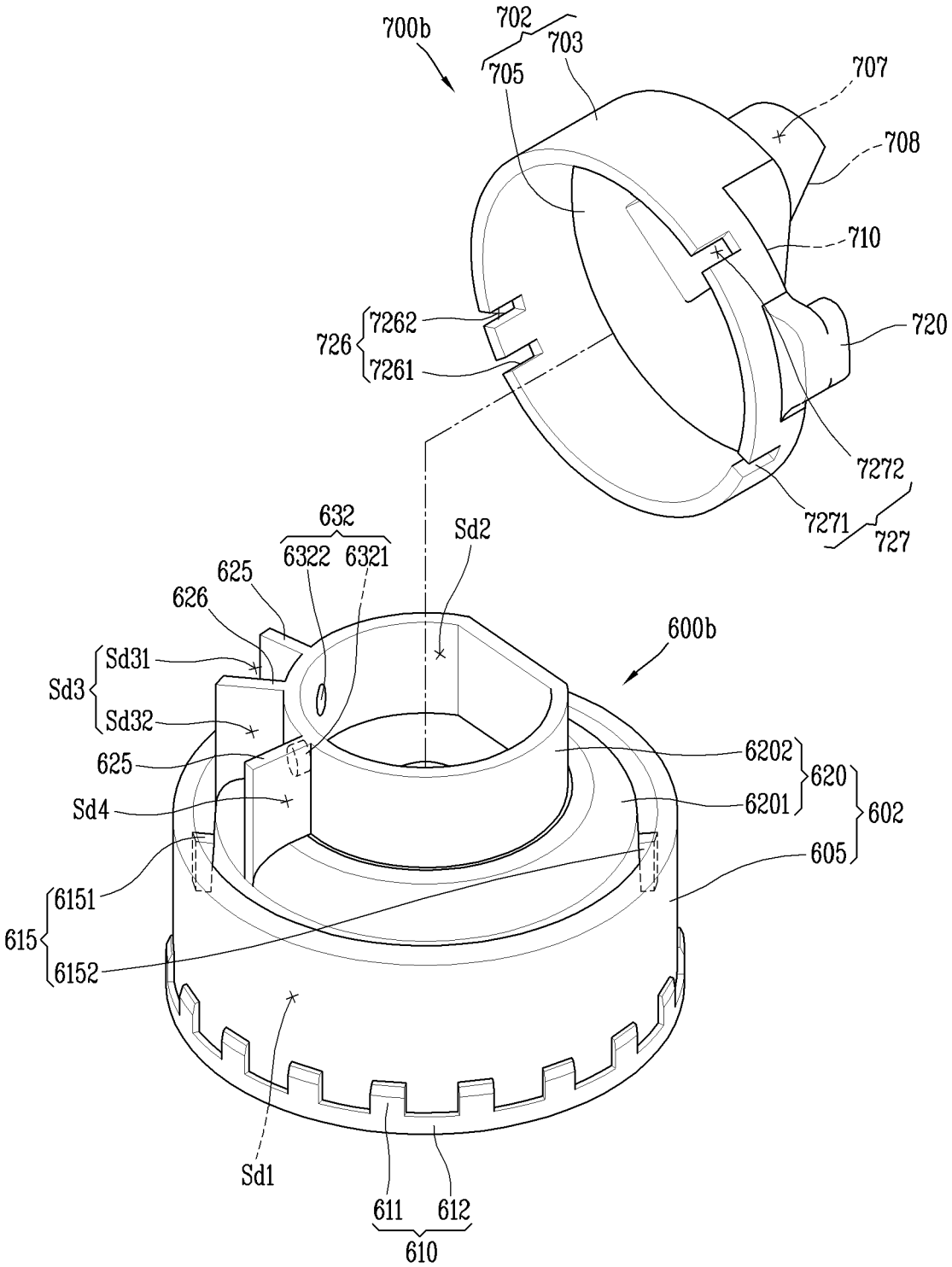
FIG. 24 is a perspective view illustrating a state before coupling a first plenum and a second plenum of a compressor in accordance with still another implementation.
Figure 25:
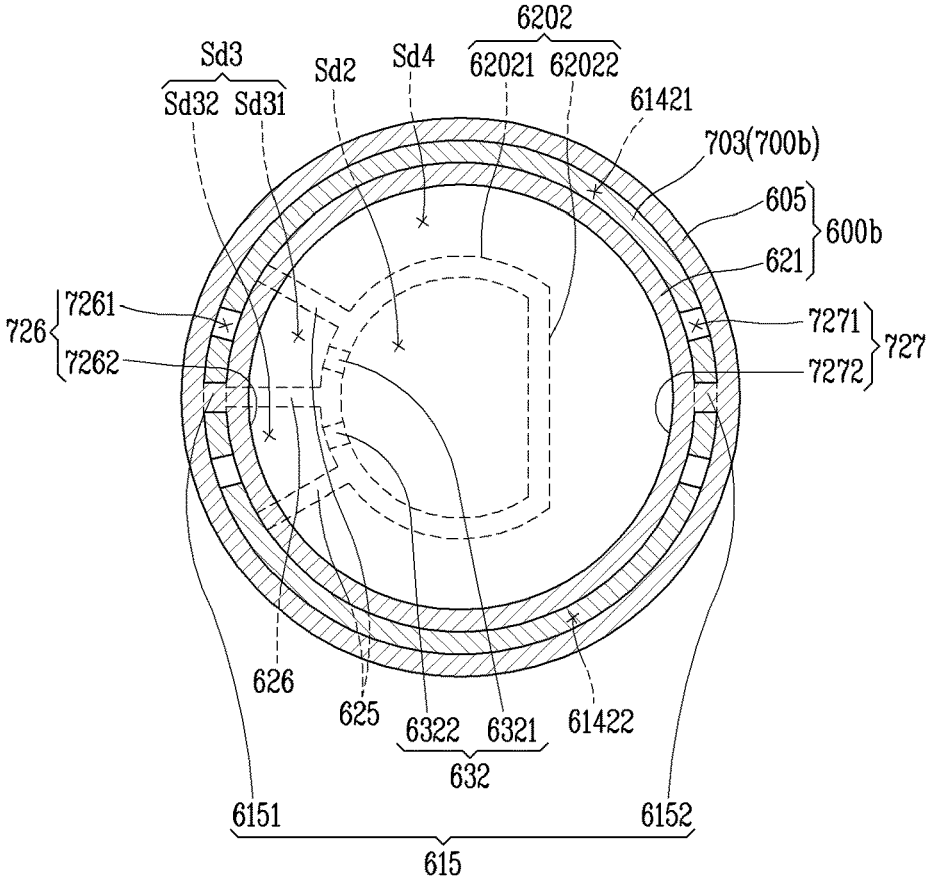
FIG. 25 is a planar sectional view illustrating a coupling region between the first plenum and the second plenum of FIG. 24.

FIG. 24 is a perspective view illustrating a state before coupling a first plenum and a second plenum of a compressor in accordance with still another implementation and FIG. 25 is a planar sectional view illustrating the coupling region between the first plenum and the second plenum of FIG. 24. As described above, a compressor according to this implementation may include a case 110, a compression unit 200, and a driving unit 400.

The driving unit 400 may include, for example, a stator 410 and a mover 430 reciprocating with respect to the stator 410.

The compression unit 200 may include, for example, a cylinder 210 defining a compression space 220, and a piston 230 reciprocating with respect to the cylinder 210 in an axial direction.

The compression unit 200 may include a frame 250 disposed at an outer side of the cylinder 210.

The compression unit 200 may include a discharge cover 510 provided on one side (front side) of the cylinder 210 to cover the compression space 220.

The discharge cover 510, as illustrated in FIG. 24, may include therein a first plenum 600*b* and a second plenum 700*b* defining a plurality of discharge spaces Sd communicating with the compression space 220.

The first plenum 600*b* and the second plenum 700*b* may be coupled to each other in the axial direction. The first plenum 600*b* may include a coupling space 614 to which the first plenum 600*b* is coupled. The first plenum 600*b* may include an outer wall 605 and an inner wall 620 concentrically disposed with the outer wall 605 to cooperatively define the coupling space 614.

The inner wall 620 may include a first inner wall 6201 disposed at an inner side of the outer wall 605 in a radial direction, and a second inner wall 6202 protruding from the first inner wall 6201 in an axial direction. The second inner wall 6202 may include an arcuate section 62021 and a linear section 62022 linearly connecting both ends of the arcuate section 62021.

The coupling space 614 may be defined between the outer wall 605 and the inner wall 620. The coupling space 614 may be defined with one side (upper side in the drawing, namely, a front side of the first plenum 600*b*) open. A first discharge space Sd1 may be defined at an inner side of the first inner wall 6201. A second discharge space Sd2 may be defined at an inner side of the second inner wall 6202.

The first plenum 600*b* may include outflow guides 625 protruding from the second inner wall 6202 in the radial direction. The outflow guide 625 may be provided as a pair spaced apart in a circumferential direction. A third discharge space Sd3 may be defined at an inner side of the outflow guides 625. A fourth discharge space Sd4 may be defined at an outer side of the outflow guides 625.

Meanwhile, the first plenum 600*b* may include a division guide 626 that divides the discharge space Sd3 partitioned by the outflow guides 625 into two spaces.

Accordingly, the third discharge space Sd3 at the inner side of the outflow guides 625 may be divided into a first partial discharge space Sd31 and a second partial discharge space Sd32.

Here, the division guide 626 may be disposed at a center between the outflow guides 625 in the circumferential direction.

Accordingly, the first partial discharge space Sd31 and the second partial discharge space Sd32 may have substantially the same volume.

When the second plenum 700*b* is coupled, an outer end portion of the division guide 626 may be brought into contact with an inner surface of the second plenum 700*b*.

A first partial outlet hole 6321 may be formed through the second inner wall 6202 such that the refrigerant in the second discharge space Sd2 can flow into the first partial discharge space Sd31.

A second partial outlet hole 6322 may be formed through the second inner wall 6202 such that the refrigerant in the second discharge space Sd2 can flow into the second partial discharge space Sd32.

Here, a cross-sectional area of the first partial outlet hole 6321 and a cross-sectional area of the second partial outlet hole 6322 may be substantially the same.

Meanwhile, a movement channel 6142 may be defined in the coupling space 614 of the first plenum 600*b* when the second plenum 700*b* is coupled.

The movement channel 6142 may be defined by the outer wall 605, the inner wall 620, and the connecting portion 630 of the first plenum 600*b*, and an end portion (rear end portion) of the second plenum 700*b* blocking an inlet of the coupling space 614.

A rib 615 for dividing the movement channel 6142 may be provided in the coupling space 614. Accordingly, the refrigerant can move in one direction (a direction without passing through the rib 615) along the movement channel 6142.

The rib 615 may include, for example, a first rib 6151 and a second rib 6152 dividing the movement channel 6142 into a first movement channel 61421 and a second movement channel 61422.

The first rib 6151 may be disposed, for example, at a region corresponding to the third discharge space Sd3.

More specifically, the first rib 6151 may be disposed on an extension line extending in an axial direction of a partition line, which extends radially from the division guide 626 to partition the coupling space 614.

The second rib 6152 may be located at an inner point of the coupling space 614 (movement channel 6142) corresponding to the same length in both directions from the first rib 6151.

Accordingly, the first movement channel 61421 and the second movement channel 61422 divided by the first rib 6151 and the second rib 6152 can have the same length.

The second rib 6152 may be configured, for example, to be rotationally symmetrical with the first rib 6151 with respect to the center of the first plenum 600*b*.

The second rib 6152 may be disposed at a center of an extension line connecting a center of the first rib 6151 and a center of the first plenum 600*b*.

The second plenum 700*b* (the cylindrical portion 703) may include a first inlet 7261 through which the first partial discharge space Sd31 communicates with the first movement channel 61421.

A cross-sectional area of the first inlet 7261 may be substantially the same as, for example, a cross-sectional area of the first partial outlet hole 6321.

The second plenum 700*b* (the cylindrical portion 703) may include a second inlet 7262 through which the second partial discharge space Sd32 communicates with the second movement channel 61422.

A cross-sectional area of the second inlet 7262 may be substantially the same as, for example, a cross-sectional area of the second partial outlet hole 6322.

As illustrated in FIG. 25, the first inlet 7261 and the second inlet 7262 may be spaced apart from each other with the first rib 6151 interposed therebetween.

The first inlet 7261 may communicate with the first partial discharge space Sd31. The second inlet 7262 may communicate with the second partial discharge space Sd32.

The second plenum 700*b* (the cylindrical portion 703) may include a first outlet 7271 communicating with the first movement channel 61421.

A cross-sectional area of the first outlet 7271 may be substantially the same as the cross-sectional area of the first inlet 7261.

The second plenum 700*b* (the cylindrical portion 703) may include a second outlet 7272 communicating with the second movement channel 61422.

A cross-sectional area of the second outlet 7272 may be substantially the same as the cross-sectional area of the second inlet 7262.

The first outlet 7271 and the second outlet 7272 may be spaced apart from each other with the second rib 6152 interposed therebetween.

The first outlet 7271 and the second outlet 7272 each may communicate with the fourth discharge space Sd4.

In this implementation, the first partial outlet hole 6321, the first inlet 7261, the first movement channel 61421, and the first outlet 7271 can have substantially the same flow cross-sectional area.

In this implementation, the second partial outlet hole 6322, the second inlet 7262, the second movement channel 61422, and the second outlet 7272 can have substantially the same flow cross-sectional area.

Figure 26:
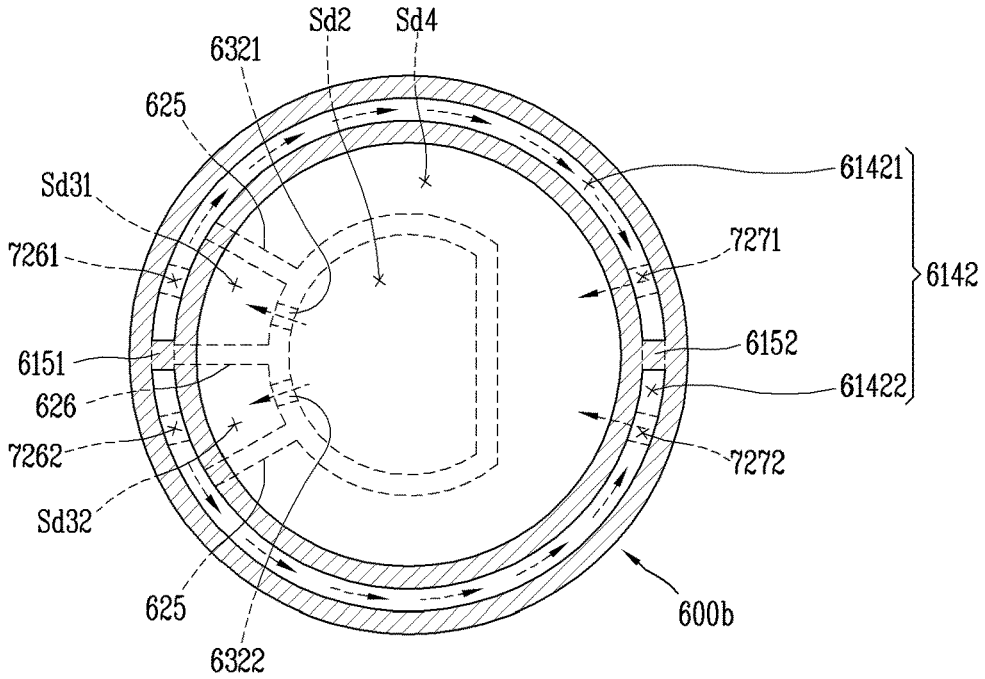
FIG. 26 is a view illustrating a refrigerant movement along a movement channel of FIG. 25.
Figure 27:
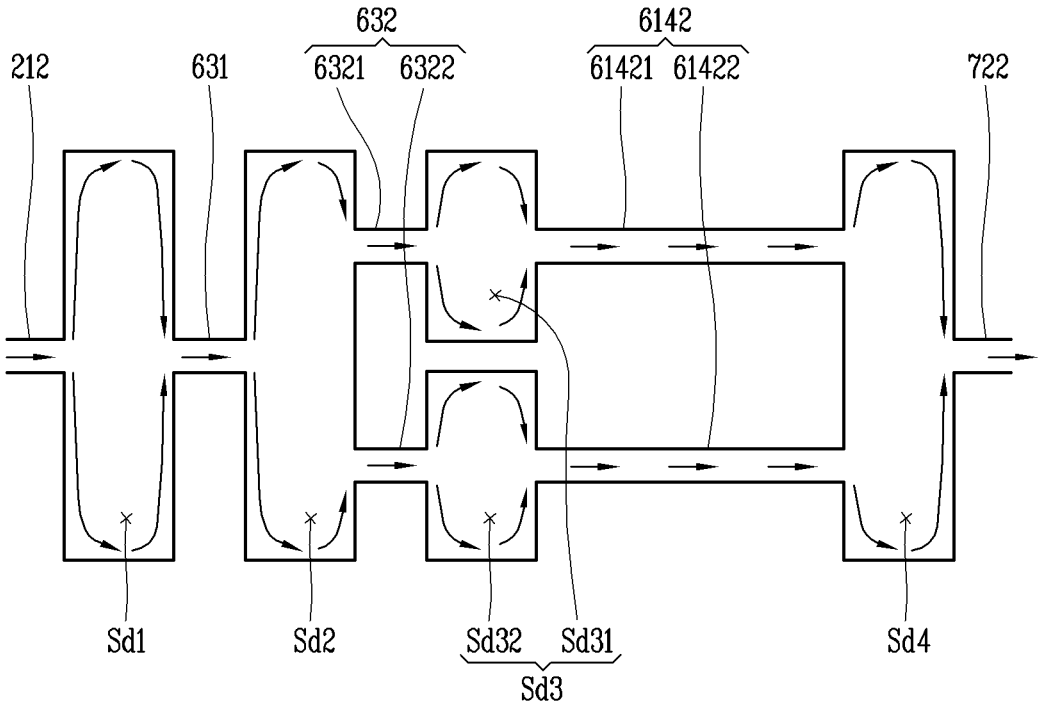
FIG. 27 is a diagram illustrating a refrigerant movement inside the discharge cover of FIG. 23.

FIG. 26 is a view illustrating a refrigerant movement along a movement channel of FIG. 25 and FIG. 27 is a diagram illustrating a refrigerant movement inside the discharge cover of FIG. 23. As illustrated in FIGS. 26 and 27, refrigerant that has been discharged from the compression space 220 and moved to the second discharge space Sd2 via the first discharge space Sd1 can be discharged into the first partial discharge space Sd31 and the second partial discharge space Sd32, respectively, through the first partial outlet hole 6321 and the second partial outlet hole 6322.

The refrigerant moved to the first partial discharge space Sd31 can move to the fourth discharge space Sd4 via the first inlet 7261, the first movement channel 61421, and the first outlet 7271.

The refrigerant moved to the second partial discharge space Sd32 can move to the fourth discharge space Sd4 via the second inlet 7262, the second movement channel 61422, and the second outlet 7272.

The refrigerant moved to the fourth discharge space Sd4 can move to the discharge groove 530 of the discharge cover 510 along the outlet groove 722.

A part of refrigerant moved into the discharge groove 530 can be discharged out of the case 110 through the discharge pipe 135 via the loop pipe 285.

Another part of the refrigerant moved to the discharge groove 530 can move along a gas movement path defined in the discharge cover 510, the frame 250, and the cylinder 210, so as to be sprayed into a gap between the inner circumferential surface of the cylinder 210 and the outer circumferential surface of the piston 230 through the nozzle of the cylinder 210. Accordingly, friction between the cylinder 210 and the piston 230 can be reduced.

In the compressor according to this implementation, a part of the refrigerant in the second discharge space Sd2 can be compressed while passing through the first partial outlet hole 6321 and expanded in the first partial discharge space Sd31. Another part of the refrigerant in the second discharge space Sd2 can be compressed while passing through the second partial outlet hole 6322 and expanded in the second partial discharge space Sd32. During the compression and expansion, pulsation can be mitigated.

In particular, a part of the refrigerant in the first partial discharge space Sd31 can move through the first inlet 7261, the first movement channel 61421, and the first outlet 7271. During the movement, an acoustic equivalent mass can be significantly increased.

Another part of the refrigerant in the second partial discharge space Sd32 can move through the second inlet 7262, the second movement channel 61422, and the second outlet 7272. During the movement, the acoustic equivalent mass can be significantly increased.

Accordingly, the pulsation can be remarkably mitigated and noise generation due to the pulsation can be remarkably reduced.

The foregoing description has been given of specific implementations of the present disclosure. However, the present disclosure may be embodied in various forms without departing from the spirit or essential characteristics thereof, and thus the above-described implementations should not be limited by the details of the detailed description.

In addition, even implementations not listed in the detailed description should be interpreted within the scope of the technical idea defined in the appended claims. It is intended that the present disclosure cover the modifications and variations of this invention provided they come within the scope of the appended claims and their equivalents.

What is claimed is:

1. A compressor comprising:

a case;

a compression unit disposed inside the case and configured to compress refrigerant; and a driver disposed inside the case and configured to apply a driving force to the compression unit, wherein the compression unit comprises:

a cylinder defining a compression space therein;

a piston configured to reciprocate inside the cylinder;

a discharge cover covering the compression space;

a first plenum disposed inside the discharge cover and having (i) a discharge space configured to communicate with the compression space, and (ii) a coupling space partitioned from the discharge space, wherein the coupling space is defined at an outer side of the discharge space in a circumferential direction, and has one side open in an axial direction;

a second plenum coupled to the first plenum, the second plenum disposed inside the discharge cover, and having an end portion configured to block an opening of the coupling space of the first plenum, thereby defining a movement channel for movement of the refrigerant;

a rib disposed inside the movement channel to block the movement channel; and a communicating portion through which the discharge space and the movement channel communicate with each other, and wherein the refrigerant discharged from the compression space moves along the discharge space, the communicating portion, and the movement channel, wherein the communicating portion comprises an inlet and an outlet disposed adjacent to the rib, wherein the rib is interposing therebetween in the circumferential direction, wherein the first plenum comprises an outer wall and an inner wall concentrically disposed with the coupling space therebetween, wherein the second plenum comprises a cylindrical portion having one end portion inserted into the coupling space, wherein the inlet and the outlet are formed by cutting the cylindrical portion, and wherein the inner wall of the first plenum comprises (i) a first inner wall disposed at an inner side of the outer wall, (ii) a second inner wall protruding from the first inner wall in the axial direction, and (iii) a plurality of outflow guides protruding from the second inner wall in a radial direction and spaced apart from each other in the circumferential direction.

2. The compressor of claim 1, wherein the inlet, the outlet, and the movement channel have a same cross-sectional area.

3. The compressor of claim 1, wherein the discharge space comprises (i) a first discharge space defined at an inner side of the first inner wall, (ii) a second discharge space defined at an inner side of the second inner wall, (iii) a third discharge space defined at an inner side of the plurality of outflow guides, and (iv) a fourth discharge space defined at an outer side of the plurality of outflow guides, wherein the third discharge space and the movement channel communicate with each other through the inlet, and wherein the fourth discharge space and the movement channel communicate with each other through the outlet.

4. The compressor of claim 3, wherein the second inner wall comprises an arcuate section formed in an arcuate shape, and a linear section linearly connecting two end portions of the arcuate section, wherein the second plenum comprises a protruding portion protruding inward in the axial direction and the radial direction to be in contact with the linear section, and wherein the fourth discharge space is defined at an inner side of the protruding portion.

5. The compressor of claim 3, wherein the first inner wall comprises a plurality of first outlet holes configured to guide refrigerant in the first discharge space to the second discharge space, and the second inner wall comprises a second outlet hole configured to guide refrigerant in the second discharge space to the third discharge space, wherein the rib comprises a first rib and a second rib spaced apart from each other in the circumferential direction partitioning the movement channel into a first movement channel and a second movement channel in the circumferential direction.

6. The compressor of claim 5, wherein the first rib and the second rib are disposed such that the first movement channel and the second movement channel have the same length.

7. The compressor of claim 5, wherein the inlet comprises a first inlet in fluid communication with the first movement channel and a second inlet in fluid communication with the second movement channel, and wherein the outlet comprises a first outlet in fluid communication with the first movement channel and a second outlet in fluid communication with the second movement channel.

8. The compressor of claim 7, wherein a cross-sectional area of the second outlet hole is the same as a sum of a cross-sectional area of the first movement channel and a cross-sectional area of the second movement channel.

9. The compressor of claim 7, wherein the first inlet and the second inlet have a same cross-sectional area, and wherein the first outlet and the second outlet have a same cross-sectional area.

10. The compressor of claim 7, wherein the first plenum further comprises a division guide dividing the third discharge space into a first partial discharge space and a second partial discharge space, wherein the second outlet hole comprises a first partial outlet hole in fluid communication with the first partial discharge space and a second partial outlet hole in fluid communication with the second partial discharge space, and wherein the first inlet is in fluid communication with the first partial discharge space, and the second inlet is in fluid communication with the second partial discharge space.

11. The compressor of claim 10, wherein a cross-sectional area of the first partial outlet hole is the same as a cross-sectional area of the first movement channel, and wherein a cross-sectional area of the second partial outlet hole is the same as a cross-sectional area of the second movement channel.

12. The compressor of claim 3, wherein the discharge cover comprises a discharge groove in fluid communication with an outside of the case, and wherein the second plenum comprises an outlet portion having an outlet groove configured to guide refrigerant in the fourth discharge space to the discharge groove.

13. The compressor of claim 12, wherein the case comprises a discharge pipe configured to discharge the refrigerant therethrough, and wherein the discharge groove includes a discharge hole in fluid communication with the discharge pipe.

14. The compressor of claim 12, wherein the cylinder comprises a nozzle configured to deliver the refrigerant into a gap defined between an inner circumferential surface of the cylinder and an outer circumferential surface of the piston, and wherein the discharge groove includes a gas bearing hole in fluid communication with the nozzle.

15. The compressor of claim 12, wherein the outlet portion protrudes from the cylindrical portion in the radial direction and extends in the axial direction, and wherein the outlet groove is defined through an inside of the outlet portion in the axial direction.

16. The compressor of claim 3, wherein the movement channel is configured to guide the refrigerant discharged from the compression space to the fourth discharge space such that the refrigerant moves in order from the first discharge space, the second discharge space, and the third discharge space.

* * * * *